US008690986B2

(12) United States Patent
Barkdoll

(10) Patent No.: US 8,690,986 B2
(45) Date of Patent: Apr. 8, 2014

(54) METHOD FOR SIMULTANEOUSLY PRODUCING IRON, COKE, AND POWER

(75) Inventor: Michael P. Barkdoll, Knoxville, TN (US)

(73) Assignee: Forest Vue Research, LLC, Knoxville, TN (US)

( * ) Notice: Subject to any disclaimer, the term of this patent is extended or adjusted under 35 U.S.C. 154(b) by 15 days.

(21) Appl. No.: 13/225,900

(22) Filed: Sep. 6, 2011

(65) Prior Publication Data

US 2012/0055287 A1 Mar. 8, 2012

Related U.S. Application Data

(63) Continuation of application No. PCT/US2011/032201, filed on Apr. 13, 2011.

(60) Provisional application No. 61/380,062, filed on Sep. 3, 2010.

(30) Foreign Application Priority Data

Mar. 15, 2011 (IN) ..... 342/KOL/2011

(51) Int. Cl.
*C21B 15/00* (2006.01)
*C21B 11/00* (2006.01)

(52) U.S. Cl.
USPC ..... 75/503

(58) Field of Classification Search
USPC ..... 75/503
See application file for complete search history.

(56) References Cited

U.S. PATENT DOCUMENTS

| | | | | |
|---|---|---|---|---|
| 3,427,148 | A | | 2/1969 | Peters et al. |
| 3,770,417 | A | * | 11/1973 | Kranz ..... 75/484 |
| 3,948,640 | A | * | 4/1976 | Elvander et al. ..... 75/10.17 |
| 3,957,486 | A | * | 5/1976 | Sandoval et al. ..... 75/490 |
| 3,985,544 | A | * | 10/1976 | Collin et al. ..... 75/10.16 |
| 6,126,718 | A | | 10/2000 | Sawa et al. |
| 2009/0025511 | A1 | | 1/2009 | Negami et al. |
| 2009/0211401 | A1 | | 8/2009 | Sendejas-Martinez et al. |

OTHER PUBLICATIONS

M. Geerdes, H. Toxopeus, and C. Van Der Vliet, Modern Blast Furnace Ironmaking: An Introduction (2004), pp. 11-15-, 59-65, and 79-86, Stahl Eisen.

J. Poveromo, R. Smailer, "Overview of Direct Reduction and Alternative Ironmaking Processes and Products;" AIST Specialty Training Conference: Scrap Substitutes & Alternative Ironmaking V, Baltimore, MD, Nov. 2-4, 2008.

(Continued)

*Primary Examiner* — Jie Yang
*Assistant Examiner* — Xiaowei Su
(74) *Attorney, Agent, or Firm* — Luedeka Neely Group, PC

(57) ABSTRACT

An alternative ironmaking process for simultaneously producing a highly metalized iron/steel product, coke from coal, an iron/steel product from an iron rich feedstock, and, optionally, energy using heat recovery. The simultaneous process is performed in the environment of a non-recovery or heat recovery coke oven. The iron rich feedstock is layered on top of a coal bed. The iron rich feedstock and coal bed are heated in the presence of a reducing gas to reduce the iron oxides of the iron rich feedstock into the iron/steel product and to devolatilize the coal into coke. After quenching the iron/steel product and coke, the iron/steel product is separated from the coke.

19 Claims, 11 Drawing Sheets

(56) References Cited

OTHER PUBLICATIONS

C. Kamijo, M. Hoshi, T. Kawaguchi, H. Yamaoka, Y. Kamei, "Production of direct reduced iron by a sheet material inserting metallization method," ISIJ International, vol. 41 (2001), Supplement, pp. S13-S16.

A. Murao, Y. Sawa, H. Hiroha, T. Matsul, N. Ishiwata, T. Higuchi, K. Takeda, "Hi-QIP, a New Ironmaking Process," Iron and Steel Technology 87-95, Mar. 2008.

* cited by examiner

METHOD FOR SIMULTANEOUSLY PRODUCING IRON, COKE, AND POWER

CROSS-REFERENCE TO RELATED APPLICATIONS

This application claims the benefit of U.S. Provisional Application No. 61/380,062, filed Sep. 3, 2010.

BACKGROUND

1. Field of Invention

The present invention relates to the production of iron. More specifically, the present invention relates to the simultaneous production of iron, coke, and, optionally, power.

2. Description of the Related Art

Accordingly to the World Steel Association, worldwide iron and steel production for 2009 stood at 1.22 billion metric tons. In terms of the ironmaking processes used, *Modern Blast Furnace Ironmaking* by M. Geerdes, H. Toxopeus and C. Van Der Vliet reports that blast furnaces account for approximately 60%, electric arc furnaces account for approximately 34%, and alternative ironmaking accounts for approximately 6% of the total iron and steel production. A description of current alternative ironmaking processes is found in the paper "Overview of Direct Reduction and Alternative Ironmaking Processes and Products," presented by Joseph J. Poveromo, Ralph M. Smailer at the Association for Iron & Steel (AIST) specialty training conference, *Scrap Substitutes & Alternative Ironmaking V* (Baltimore, Md., Nov. 2-4, 2008). In the United States, for example, blast furnaces account for more than half (approximately 55%) of all crude steel produced. Blast furnaces dominate global iron and steel production, and one can expect that trend to continue for decades to come, especially in regions, such as Asia, lacking sufficient raw materials to sustain high production levels from electric arc furnace operations.

The blast furnace process uses a large, countercurrent, high temperature reactor to reduce iron oxides and melt the iron/steel product. A comprehensive description of modern blast furnace operating practices is found in *Modern Blast Furnace Ironmaking*. The majority of modern blast furnaces use coke as the primary reductant and iron ore pellets or sinter as the primary iron rich feedstock. In summary, a modern blast furnace is characterized by the use of pulverized coal injection, oxygen enrichment, high blast temperatures, proper raw material loading (burdening) equipment, high quality coke, proper feedstock preparation, water cooled panels, and fully instrumented process control. A large modern blast furnace can produce in excess of 10 000 metric tons of high quality hot metal each day.

Electric arc furnace processes have evolved rather quickly in comparison to blast furnace processes and technological advances over the past twenty years or so have allowed this technology to increase its proportion of total steel production. The electric arc furnace process is a melting process only. Very little reduction takes place during the electric arc furnace process. Accordingly, the electric arc furnace process is largely dependent on cost effective and reliable sources of iron. The predominant feedstock is scrap. The amount of trace contaminants in the scrap determines the quality of the feedstock. Feedstock quality dictates hot metal quality and hence steel quality. With recent technological advances and strict raw material controls, the electric arc furnace route has made in-roads into the higher priced flat products markets. A large modern electric arc furnace can produce in excess of 4000 metric tons of hot metal each day.

Because a blast furnace represents a huge capital expenditure, productivity, which is measured in metric tons of hot metal divided by the working volume of the blast furnace ($THM/m^3$) is closely watched by steel producers. Productivity of a blast furnace is limited primarily by furnace permeability and gas distribution within the iron ore burden. Furnace permeability refers to the amount of gas (i.e., air, oxygen, products of combustion) that can be forced through the blast furnace by the high pressure turbo-blowers supplying hot blast air. Gas distribution refers to a more or less equal bulk gas flow up through the iron ore burden to provide sufficient contact time for reduction and melting.

The pressure drop (resistance to gas flow) in a blast furnace is estimated from the Ergun Equation:

$$\frac{\Delta P}{L} = \frac{(1-\varepsilon)^2 U\mu}{\varepsilon^3 \Phi^2 (Dp)^2} \tag{1}$$

where ΔP is the pressure drop across the bed, L is the length of the bed, $\epsilon$ is the void fraction of the bed, U is the superficial fluid velocity of the fluid, μ is the dynamic viscosity of the fluid, Φ is the sphericity of the particles, and $D_p$ is the equivalent spherical diameter of the particles. For all practical purposes, more gas means greater productivity.

The form of the feedstock has a significant effect on productivity. Feedstock forms that improve blast furnace productivity are generally preferred and command higher market values than the less desirable counterparts. The common forms of iron ore used in conventional and alternative ironmaking processes include fine ore, lump, pellet, and briquette. Fine ore, or fines, is defined as iron ore with the majority of individual particles having diameters measuring less than 4.75 mm (0.1875 in). Lump is defined as iron ore with the majority of individual particles having diameters measuring more than 4.75 mm (0.1875 in). Pellets are generally defined as shaped iron ore concentrate mixed with a binder and hardened with average diameters of in the range of approximately 9.55 mm to approximately 16.0 mm (0.375 in to 0.625 in). Briquettes are agglomerations of iron ores in blocks with exemplary lengths in the range of 50 mm to 140 mm (1.97 in to 5.5 in), widths in the range of 40 mm to 100 mm (1.6 in to 3.9 in), and thickness in the range of 20 mm to 50 mm (0.79 in to 1.97 in).

Compared to the larger diameters and irregular shapes of lumps or briquettes, pellets generally produce a higher resistance to gas flow in a blast furnace. Conversely, pellets generally exhibit higher reduction and melting rates because the smaller diameter of pellets equates to a larger specific surface area. For blast furnace operators, pellets represent a compromise between optimal furnace permeability and effective reduction and melting.

In addition to the conventional blast furnace and electric arc furnace process, a brief survey of select alternative ironmaking processes is presented. The prior art is replete with various attempts to co-mix iron ore fines and metallurgical coal together and then process the mixture in a coke oven to produce a material suitable for blast furnace operations. An example of such work is U.S. Pat. No. 3,427,148 issued to Peters, et. al (the '148 patent). Although the '148 patent discloses that reduction of the iron in the mixture can be achieved even at low temperatures in the range of 1000° C. to 1204° C. (1832° F. to 2200° F.), it is well known that the coke produced by such coal/iron blends is not suitable for blast furnace operations. The coke with partially reduced iron interspersed is small, weak, and highly susceptible to $CO_2$ attack in modern blast furnace operations. Moreover, the primary product (coke) quality is so greatly diminished that this is not a viable process.

The Sheet Material Inserting METallization (SMIMET) study described in *Production of direct reduced iron by a sheet material inserting metallization process*, ISIJ International, Vol. 41 (2001), Supplement, pp. S13-S16 (Kamijo, C., Hoshi, M., et. al.), investigated the possibility of using a rotary hearth furnace for production of Direct Reduced Iron (DRI) without the need for special preparation (pelletizing) of the raw materials. The SMIMET study was a laboratory study to determine the efficacy of mixing fine coal (94% of the particles having diameters less than 125 μm), fine ore (both hematite and magnetite with 94% of the particles having diameters less than 125 μm), and water, forming a 10 mm sheet of raw material in a nickel or alumina container, and placing this material into an inert atmosphere ($N_2$ or $CO_2$) electrically heated furnace at 1300° C. (2372° F.). The results of the SMIMET process study showed that iron reduction is possible using the volatile material devolatilized directly from coal, reduction occurs at a fairly fast rate (i.e., 10 mm converted in 15 min), and showed that a high degree of metallization (% metallic Fe divided by % total Fe) could be achieved in as little as 15 minutes. While the study showed promising results, the SMIMET process requires a rotary hearth furnace with all of its ancillary equipment. A rotary hearth furnace is quite expensive to build and the associated fuel/power costs are also substantial. Applicability of the DRI product as a blast furnace feed material is unknown and cannot be assumed because the SMIMET study makes no mention of the size, shape, or strength of the product. To date, no commercialization of the SMIMET process is known to the present inventor.

The COal-based METallization (COMET) process developed by the Centre for Research in Metallurgy in Liege, Belgium is very similar to the SMIMET process previously described. Notable differences are that, rather than mixing the iron oxides and coal, these two raw materials are fed onto the rotary hearth in alternating layers. The product produced by the COMET process is flat slabs of sintered DRI that must be cut, screened, and cooled for product recovery. The sintered DRI product generated by the COMET process would be suitable for electric arc furnace steel making but not for blast furnace steel making or foundry operations. Like the SMIMET process, the COMET process would require significant capital investment plus auxiliary fuels (natural gas, coke oven gas or pulverized coal). The devolatilized coal (char) is a waste product of little to no economic value.

The High-Quality Iron Pebble (Hi-QIP) process described in U.S. Pat. No. 6,126,718 to Sawa, et. al. (the '718 patent), represents an advancement on the SMIMET and COMET processes in that it does operate at temperatures sufficiently high to produce a form of pig iron. The product of the Hi-QIP process is referred to as iron pebble. As with the SMIMET and COMET processes, the Hi-QIP process uses a rotary hearth furnace with its attendant high capital cost and supplementary fuel requirements in order to operate at temperatures adequate to melt the iron. The '718 patent discloses that the iron pebbles are suitable for both electric arc furnace and blast furnace operations. The article, "Hi-QIP, A New Ironmaking Process," by Sawa, et al., in Iron and Steel Technology 87-94 (March 2008) describes problems associated with commercialization of this process. Most notably they cite the "furnace energy efficiency and reduction of fuel unit consumption."

It is important to note that the SMIMET process, the COMET processes, and the Hi-QIP process all produce DRI, which is higher quality than pig iron but significantly more costly to produce. The higher production costs effectively limit the use of DRI to electric arc furnaces which require higher quality raw materials. Because a blast furnace can process lower quality and cost raw materials, an ironmaking process that further reduces the cost of the raw materials while maintaining the minimum raw material quality or increases the quality of the raw materials without increasing the raw material cost is critical.

Clearly, the fundamentals of reducing iron oxides into metallic iron are well established. An iron oxide in the presence of a reducing gas is heated to create the reducing reaction. In a laboratory setting, a process for reducing small quantities of most any iron oxide should be achievable if the practicalities necessary for economic sustainability in a commercial setting are ignored. In other words, a successful process developed and tested in a laboratory on small quantities of raw materials may prove the concept, yet fail to provide a solution to the real world problems faced by the iron and steel industry. Many proposed industrial technology development projects have historically failed due to scale up problems. Scale up problems occur in processes that have been proven at the bench scale level (laboratory scale), and even at the pilot plant level (nominally about 1% to 5% of full scale), but have failed at the full scale production level. In the very broadest of terms, a vast majority of these failures have occurred because the small scale process is a continuous process that cannot be sustained at an industrial level, the reactions occur in spherical or cylindrical reactors that are not reproducible at an industrial level, or the reduced scale reaction kinetics cannot be achieved in a full scale production facility.

A fundamental challenge is the production of sufficient quantities of quality raw materials to meet the demands of the iron and steel industry. In this context, sufficient quantities are measured in metric tons. In evaluating the solution, the efficiency and cost are significant factors. The cost includes the costs associated with obtaining and processing the raw material. A "successful" but energy inefficient laboratory reduction process is not a solution when scaled up to a commercial setting. In other words, if the operating costs of the scaled process offset the advantages of using a low cost raw material or if the scaled process cannot produce sufficient quantities of the iron/steel product in a timely fashion, it amounts to little more than theory with no practical application.

BRIEF SUMMARY

The following Brief Summary is provided to introduce a selection of concepts in a simplified form that are further described below in the Detailed Description. This Brief Summary is not intended to identify key features or essential features of the claimed subject matter, nor is it intended to be used to limit the scope of the claimed subject matter.

An alternative ironmaking process for simultaneously producing a highly metalized iron/steel product from an iron rich feedstock, coke from coal, and, optionally, energy using heat recovery (referred to as the simultaneous process) is described herein. The simultaneous process is performed in the environment of a non-recovery or heat recovery coke oven. The iron rich feedstock is layered on top of a coal bed. The feedstock and coal bed are heated in the presence of a reducing gas to reduce the iron oxides of the iron rich feedstock into an iron/steel product and to devolatilize the coal into coke. After quenching the iron/steel product and coke, the iron/steel product is separated from the coke.

The simultaneous process is implemented in a non-recovery or heat recovery coke oven and successfully reduces a wide variety of iron rich feedstock including many normally considered to be undesirable due to low blast furnace productivity. The iron rich feedstock suitable for use in the simultaneous process include, but are not limited to, mill scale, electric arc furnace dust (after thermal treatment to remove and recover zinc), hematite fines, magnetite fines, blast furnace dust, blast furnace sludge, basic oxygen furnace dust, basic oxygen furnace sludge, and oily mill scale. While the iron/steel product produced using the simultaneous process varies based on the iron rich feedstock used, the iron/steel product typically ranges in grade from pig iron to ultra-low carbon steel. Further, the iron/steel product produced during the simultaneous process can include more than one grade of iron or steel. When performed using a heat recovery coke oven, the simultaneous process also produces energy from waste heat recovery.

A coke oven operates at temperatures sufficient to accelerate the reduction reactions and to melt the iron. The temperatures that occur on top of the bed in the coke ovens during the simultaneous process are generally in the range of 1301° C. to 1460° C. (2375° F. to 2660° F.). Reduction begins to occur at temperatures of approximately 982° C. (1800° F.) and reaction rates increase at higher temperatures. The melting points of steels and reduced irons range between 1200° C. to 1427° C. (2192° F. to 2600° F.). Iron oxides typically melt at temperatures above 1538° C. (2800° F.).

Moreover, the simultaneous process continuously surrounds the iron bearing material in a coke oven with a highly effective, high concentration of heated reducing gases. As the concentration of reducing gases increases, the reduction reactions occur at a faster pace. In conjunction with the long coking times, the thick coal/coke bed continues to devolatilize and release the reducing gases into the coke oven. The gases emanating from the bed in a coke oven are essentially pure reducing gases ($H_2/CH_4/CO$). The composition of the atmosphere above the coal/coke bed by typical volume fraction (concentration) is 41% $H_2$, 19% $CH_4$, and 6% CO. The relatively high percentage of hydrogen devolatilized during the coking process is beneficial to the simultaneous process because the small size of the $H_2$ molecule makes it one of the most effective reductants.

In a heat recovery coke oven, the simultaneous process occurs as follows. A bed of coal topped with a layer of iron rich feedstock is charged into the coke oven. Sole flues heat the bed from the underside and radiant heat reflected by the oven crown heats the top of the bed. Heated air is from the heat recovery coke oven is collected by uptake vents and channeled into the waste heat tunnel for heat/energy recover. The length of the coking cycle (i.e., the time period required to convert metallurgical coal into metallurgical coke) is dictated by the multiple phase changes that occur in the coking process namely solid (coal) to liquid (tar) and back to solid (coke) as well as the poor heat transfer through coke due to its 50% porosity. Non-recovery or heat recovery coke making is a batch process with a normal coking cycle in the range of 24 hours to 72 hours. The thickness of the coal bed is related to the length of coking cycle. More specifically, the bed thickness is selected to allow the coal to completely devolatilize into coke during the coking cycle.

Approximately four hours into the simultaneous process, the bed has begun devolatilizing and off-gassing the volatile materials (i.e., the reducing gas). As it devolatilizes, a portion of the bed changes to a liquid and forms a tar seam. As the devolatilization process continues, the liquid portion of the bed returns to a solid in the form of coke. As a result of the shrinkage of the bed during the devolatilization process, a series of cracks form in the bed. The reducing gas passing through and surrounding the iron rich feedstock causes reduction of the iron oxides to occur. Approximately 24 hours into the simultaneous process, larger cracks appeared and some of the molten iron/steel product has flowed into the cracks. At the conclusion of the simultaneously process, the bed has completely devolatilized. Most of the molten iron/steel product has flowed into the cracks. The iron/steel product on or near the surface of the bed tends to be of a lesser grade than the iron/steel product found in the cracks.

The simultaneous process provides two basic mechanisms that prevent the molten metal from coming in contact with the refractory materials of the coke oven, which would be severely damaged by contact with the molten iron and iron oxides. First, the bed has a steeply declining temperature gradient from the outer surface to the middle. As a result, molten metal cools significantly as it runs deeper into the cracks formed in the bed until it solidifies. The inventor found that the molten metal typically flows only a matter of inches into the cracks before solidifying. Second, as described above, the coking process changes coal (a solid) into tar (a liquid) before it changes into coke (a solid). The tar seam begins at the perimeter of the bed and slowly moves inwardly during the coking cycle. At the conclusion of the coking cycle, the tar seam is located approximately midway through the thickness of the bed. The tar seam serves as an additional barrier that prevents the molten metal from passing through the bed to the underlying refractory materials.

During the post-coking handling, the iron/steel product is optionally separated from the coke at one or more of several different locations. One technique uses an electromagnet to separate the iron rich feedstock from the coke. Once separated, the electromagnet deposits the iron/steel product at a collection site for processing, storage, and/or transport. Because the iron/steel product is magnetic and the coke is not, separation is efficient, timely, and nearly 100% complete. Any fractional cross-contamination (coke in the iron/steel product or iron/steel product in the coke) does not materially impact the economic value of the iron/steel product or the coke. For example, if the iron/steel product went to an electric arc furnace, carbon (i.e., coke) is normally added to the melt. In a blast furnace, both iron and coke are charged. Separation allows the producer to sell the iron/steel product and the coke to blast furnace operators or to electric arc furnace operators depending on market conditions or to independently sell the iron/steel product and the coke.

Numerous combinations of sizes and shapes for the iron/steel product are available and are selected to improve the blast furnace productivity. To control the size and shape of the iron/steel product, the simultaneous process optionally creates a plurality of cavities of the desired shape in the top surface of the bed during the stamp charging process. Each mold cavity is surrounded by a sloped region. The sloped region, in combination with gravity, directs the molten metal into the mold cavities, substantially filling the cavities. The diameter of the sloped region is selected to direct a sufficient volume of the iron/steel product to substantially fill the cavity into each mold cavity.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Figure 1:
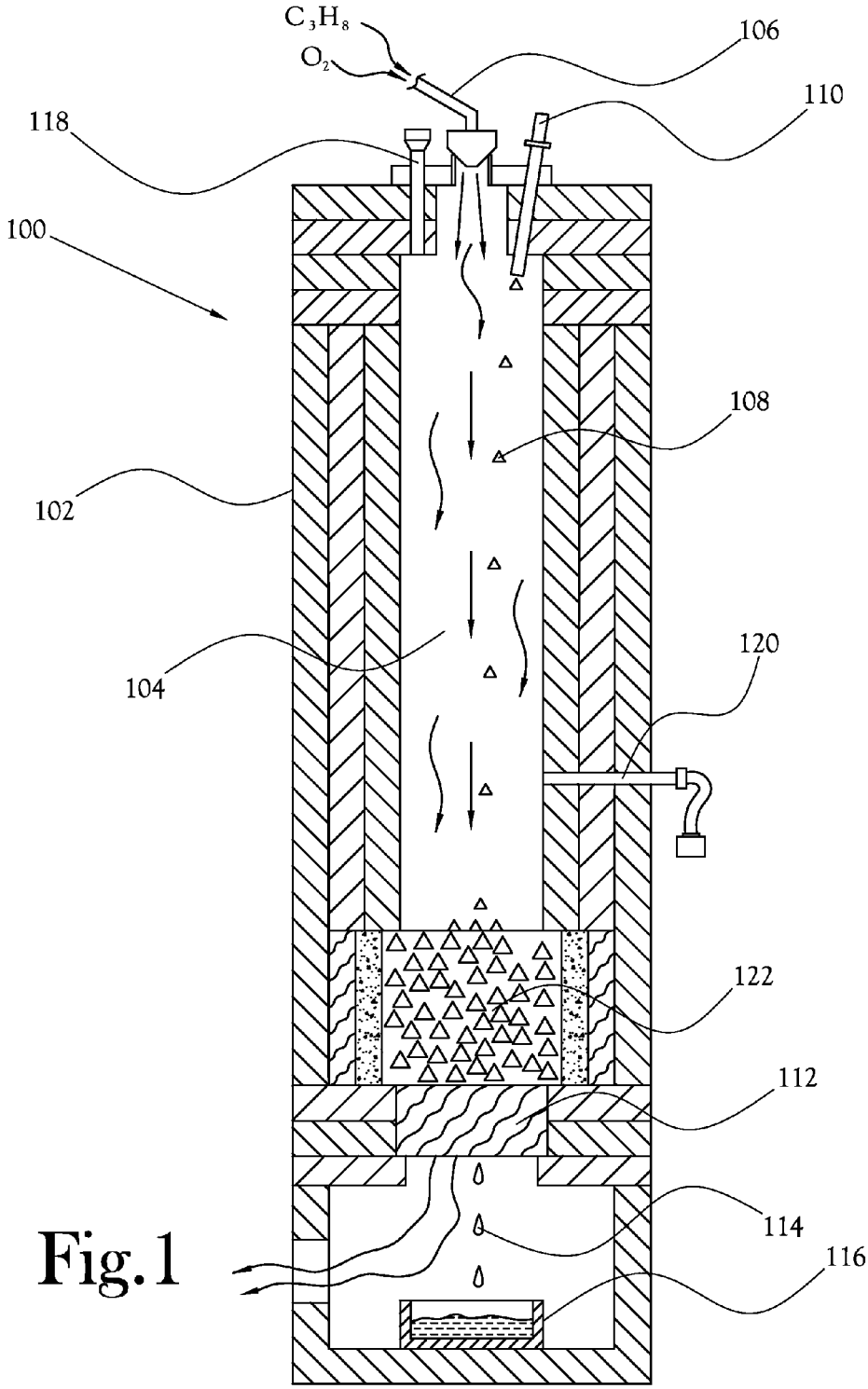
FIG. 1 depicts the first reactor designed and tested by the inventor in developing the present invention.

An alternative ironmaking process for simultaneously producing a highly metalized iron/steel product from an iron rich feedstock, coke from coal, and, optionally, energy using heat recovery (referred to as the simultaneous process) is described herein and illustrated in the accompanying figures. The simultaneous process is performed in the environment of a non-recovery or heat recovery coke oven. The iron rich feedstock is layered on top of a coal bed. The feedstock and coal bed are heated in the presence of a reducing gas to reduce the iron oxides of the iron rich feedstock into an iron/steel product and to devolatilize the coal into coke. After quenching the iron/steel product and coke, the iron/steel product is separated from the coke.

For purposes of the detailed description, the following terms should be treated as referring to the things specified as follows unless the text expressly indicates that a different association is intended. The term "coke oven" refers to non-recovery coke ovens, heat recovery coke ovens, and other horizontal coke ovens. The term "bed" refers to the coal and coke, as applicable, being processed in a coke oven. The term "flat push" refers to the unloading of the bed from the coke oven into a hot car after completion of the coking cycle where the floor of the hot car is substantially at the same level as the floor of the coke oven. The terms "iron rich feedstock" and "feedstock" refers to unreduced oxides of iron of any form that are suitable for use in the simultaneous process described herein. The term "iron/steel product" refers to the reduced or pre-reduced iron, steel, or combination of iron and steel produced using the simultaneous process described herein. Prices are given in United States dollars (USD). Tonnage values are given in metric tons (T).

In order to be comprehensive, it should be noted that the current invention can also produce a high quality raw material for the iron foundry industry. On an annual tonnage basis, the foundry industry is quite small compared to the steel industry; however its products can command substantially higher prices. While the foundry industry will not be described in detail, it must be recognized that the product from the current invention can be readily used as a raw material in the iron foundry industry.

Iron and steel are graded or categorized by the alloy contents, most notably the carbon content. In descending order, the grades are pig iron (3.5% to 4.5%), cast iron (2.0% to 3.5%), ultra-high carbon steel (1.0% to 2.0%), high carbon steel (0.6% to 1.0%), medium carbon steel (0.3% to 0.6%), low carbon steel (0.05% to 0.3%), and ultra-low carbon steel (less than 0.05%). These grades and the specified carbon contents are not intended to limit the simultaneous process described herein in any way. The minimum target quality for the highly metalized iron or steel product is pig iron. The simultaneous process produces an iron product ranging from pig iron to ultra-low carbon steel.

In arriving at the present invention, the inventor designed, built, and tested a number of reactors for reducing low cost iron rich material to a highly metalized iron or steel product. It is believed to be beneficial to discuss the reactor designs and testing that preceded the development of the simultaneous process.

FIG. 1 depicts the first reactor 100 constructed by the inventor. Reactor No. 1 was a co-current, down flow reactor envisioned to perform initial surface reduction/melting of fine iron ore with subsequent capture in a nut coke bed 122 with continued reduction/melting. The body 102 of the first reactor has a square cross section and was fabricated of multiple layers of refractory board material rated at 1538° C. (2800° F.) to form a reduction chamber 104. A torch 106 burning propane and oxygen introduces the heated reducing gas into the reduction chamber 104. An iron rich feedstock 108 is introduced near the top of the reduction chamber 104 through feedstock port 110. The feedstock 108 drops through the reducing chamber to a ceramic foam filter (frit) 112 fabricated from yttrium stabilized zirconia (YSZ). As the feedstock 108 melts the resulting product 114 is collected in a crucible 116. A sight port 118 allows visual monitoring of the feedstock 108 while in Reactor No. 1. A thermocouple 120 in the body 102 allows monitoring of the temperature in the reduction chamber 104.

Reactor No. 1 was operated numerous times during the winter and spring of 2008. Minor amounts of product (iron) were produced. The reactor was finally abandoned due to severe operational difficulties, lack of product, and complexity. In particular, controlling high temperatures in excess of 1538° C. (2800° F.) and the flow of the reducing gas proved extremely difficult. Further, the nut coke catch bed tended to disappear early in a run or during a run probably due to the Boudouard Reaction: $C+CO_2 \rightarrow CO$. Finally, the yttrium stabilized zirconia (YSZ) foam filter suffered severe damage.

Figure 2:
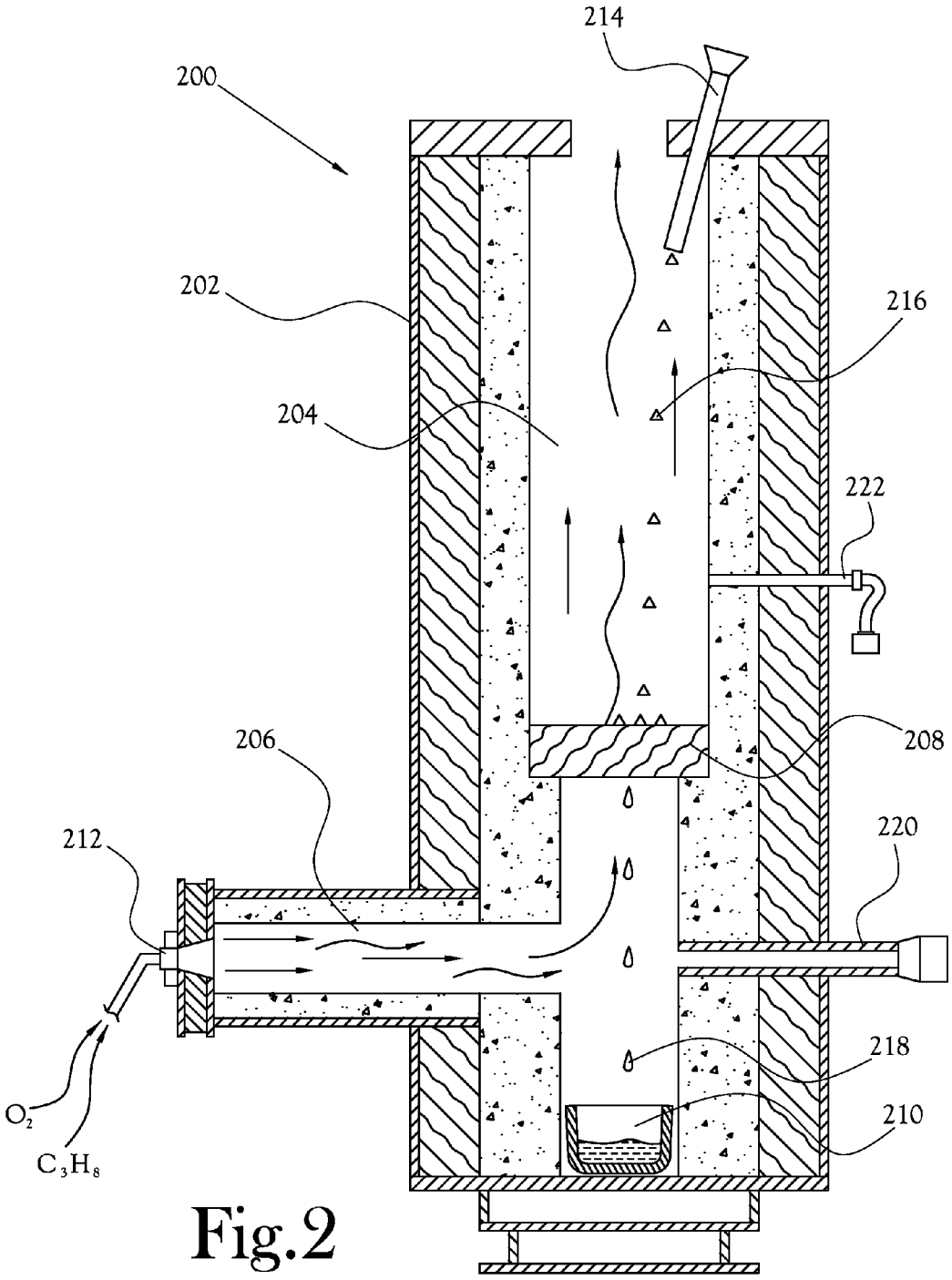
FIG. 2 depicts the second reactor designed and tested by the inventor in developing the present invention.

FIG. 2 depicts a second reactor 200 based on a countercurrent design constructed after the failure of Reactor No. 1. Reactor No. 2 includes a cylindrical body 202 forming the reducing chamber 204 with an offset firing chamber 206, a YSZ ceramic foam filter (frit) 208, and a crucible 210 for collecting the resulting product. The body 202 and the firing chamber 204 were fabricated from a dense castable ceramic rated to approximately 1650° C. (3000° F.). A torch 212 burning propane and oxygen produces a heated propane/oxygen reducing gas. Upon exiting the firing chamber, the reducing gas passes upward through the frit 208 into the reduction chamber 204. A feedstock port 214 introduces an iron rich feedstock 216 of fine magnetite near the top of the reducing chamber 204 so that the feedstock falls through the countercurrent reducing gas and onto the frit 208. As the feedstock 216 melts the resulting product 218 is collected in a crucible 210. A sight port 220 is provided to visually monitor the burner chamber 206. A thermocouple 222 allows for monitoring temperature in the reducing chamber 204.

Multiple problems were encountered in operating Reactor No. 2. In designing Reactor No. 2, the inventor contemplated that reduction and some melting of the feedstock would occur during free fall and would conclude while the feedstock rested on the filter allowing the molten iron/steel product to pass through the filter and be collected in the crucible below. In order for the desired reduction and melting of the feedstock to occur, the temperature of reducing gas in the reducing chamber must be in the range of about 1371° C. (2500° F.) to about 1538° C. (2800° F.). The most salient problem with Reactor No. 2 was that in order to reach the desired temperature in the reducing chamber, the corresponding operating temperature in the firing chamber ultimately exceeded the temperature rating of and melted the dense castable lining. Additionally, the yield of the iron ore product was very low due to the tendency of the feedstock to melt and run through the ceramic filter without reducing to metallic iron. Further, the frit repeatedly exhibited severe damage as a result of the process within in a matter hours and sometimes within a matter of minutes. Finally, the temperature of the reducing chamber, especially temperatures above 1370° C. (2500° F.), were extremely difficult to control. After two successive burner chamber failures, Reactor No. 2 was abandoned.

Figure 3:
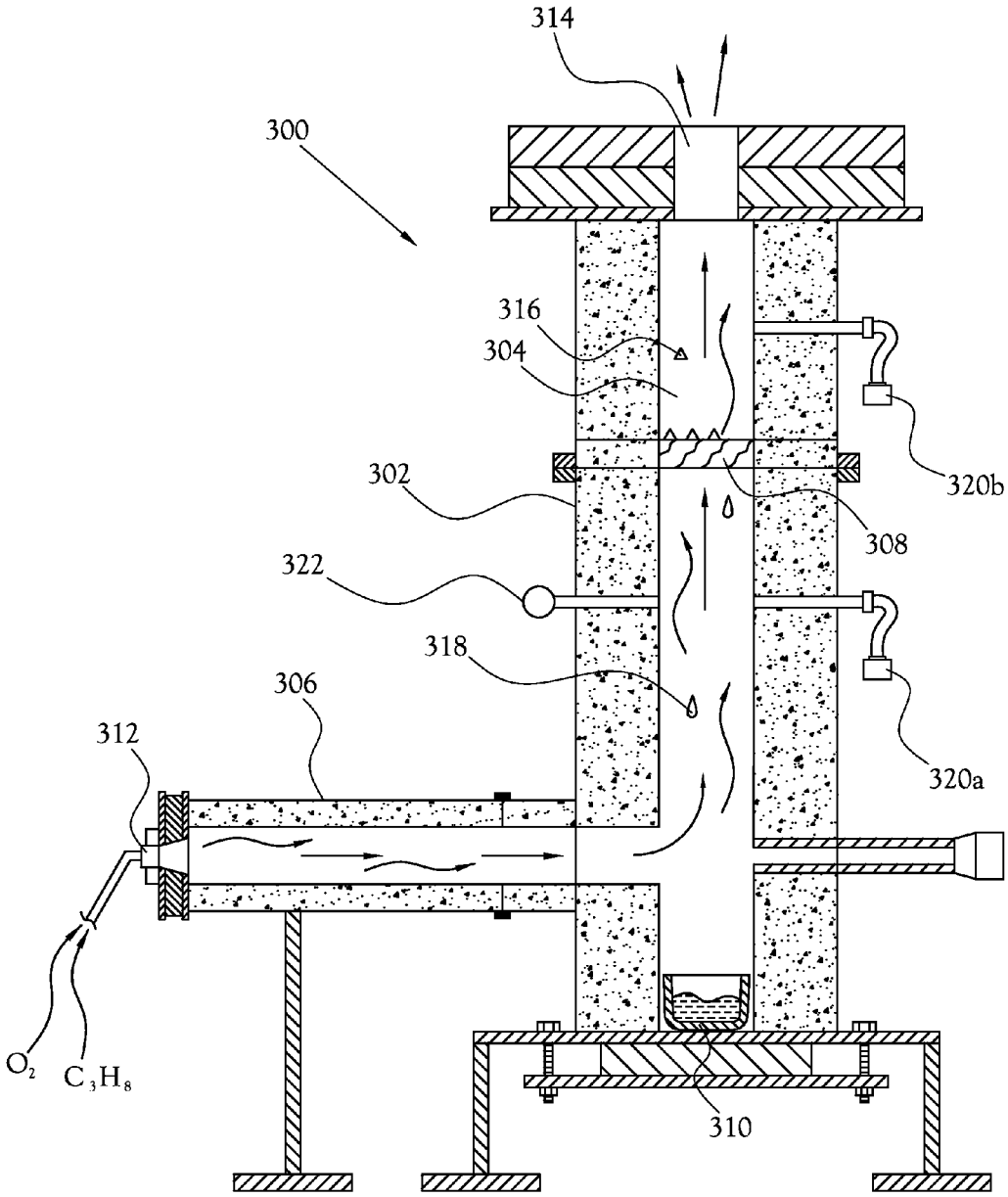
FIG. 3 depicts the third reactor designed and tested by the inventor in developing the present invention.

FIG. 3 depicts a third reactor 300 constructed after Reactor No. 2 was abandoned. Reactor No. 3 shared a similar design with Reactor No. 2, but was larger and more structurally sound. Reactor No. 3 includes a cylindrical body 302 forming the reducing chamber 304 with an offset firing chamber 306, a YSZ ceramic foam filter (frit) 308, and a crucible 310 for collecting the resulting product. The body 302 and the firing chamber 306 were fabricated from a dense castable ceramic rated to approximately 1650° C. (3000° F.). A torch 312 burning propane and oxygen produces a heated propane/oxygen reducing gas. Upon exiting the firing chamber, the reducing gas passes upward through the frit 308 into the reduction chamber 304. A vent opening 314 allows a feedstock 316 of fine magnetite to be introduced near the top of the reducing chamber 304 so that the feedstock falls through the countercurrent reducing gas and onto the frit 308. As the feedstock 316 melts the resulting product 318 is collected in a crucible 310. To monitor the temperature of the heated reduction gases, Reactor No. 3 includes two thermocouples 320*a*, 320*b*. A pressure gauge 322 is provided to monitor the gas pressure.

Reactor No. 3 was operated through seven test programs using a number of differing construction materials and a variety of feedstocks. The various construction materials tested in Reactor No. 3 included, but were not limited to, fits fabricated from yttrium stabilized zirconia (YSZ), graphite, silicon carbide (SiC), and pitch impregnated magnesium oxide (MgO). The feedstock materials tested in Reactor No. 3 included, but were not limited to, PRB coal, metallurgical coal, hematite, and magnetite in the form of fine ore and in pellets similar to those used in the MIDREX™ ITmk3® process.

Although Reactor No. 3 did not prove to be effective in the production of metallic iron, the results of the tests provided valuable insight to as to the suitability of the various feedstocks and construction materials tested and of the reactor configuration required for the production of metallic iron from low cost feedstocks and reductant gases. In terms of the suitability of the materials used to construct the reactor, the tests showed that:

- YSZ was very susceptible to degradation by water vapor (product of combustion) at elevated temperatures.
- SiC reacted with and was destroyed by FeO/Fe at high temperatures.
- Graphite was totally destroyed at operating temperatures and/or by the presence of FeO/Fe at operating temperatures.

In terms of reactor design, Reactor No. 3 was an improvement but still shared many of the shortcomings of Reactor No. 2. Testing showed that:

- Reactor No. 3 was stable, but, as with Reactor No. 2, maintaining reducing conditions and temperature was operationally challenging.
- Reactor No. 3 remained subject to the attacks on the dense castable linings that plagued Reactor No. 2.
- As with Reactor No. 2, the design of Reactor No. 3 failed to provide sufficient residence time at temperature and reducing conditions, which led to the melting of the iron oxides ($FeO/Fe_2O_3/Fe_3O_4$) before full reduction could occur. The resulting product collected in the crucible was commonly a mixture of slag, Fe, FeO, iron silicates, and other oxides.
- The exhaust from Reactor No. 3 contained particles, such as glowing iron ore and coal ash, that would cause real problems downstream (e.g., during the heat recovery process) in a full scale industrial unit.

Based on the observed results from Reactor No. 3 a radically different approach was developed for Reactor No. 4.

Figure 4:
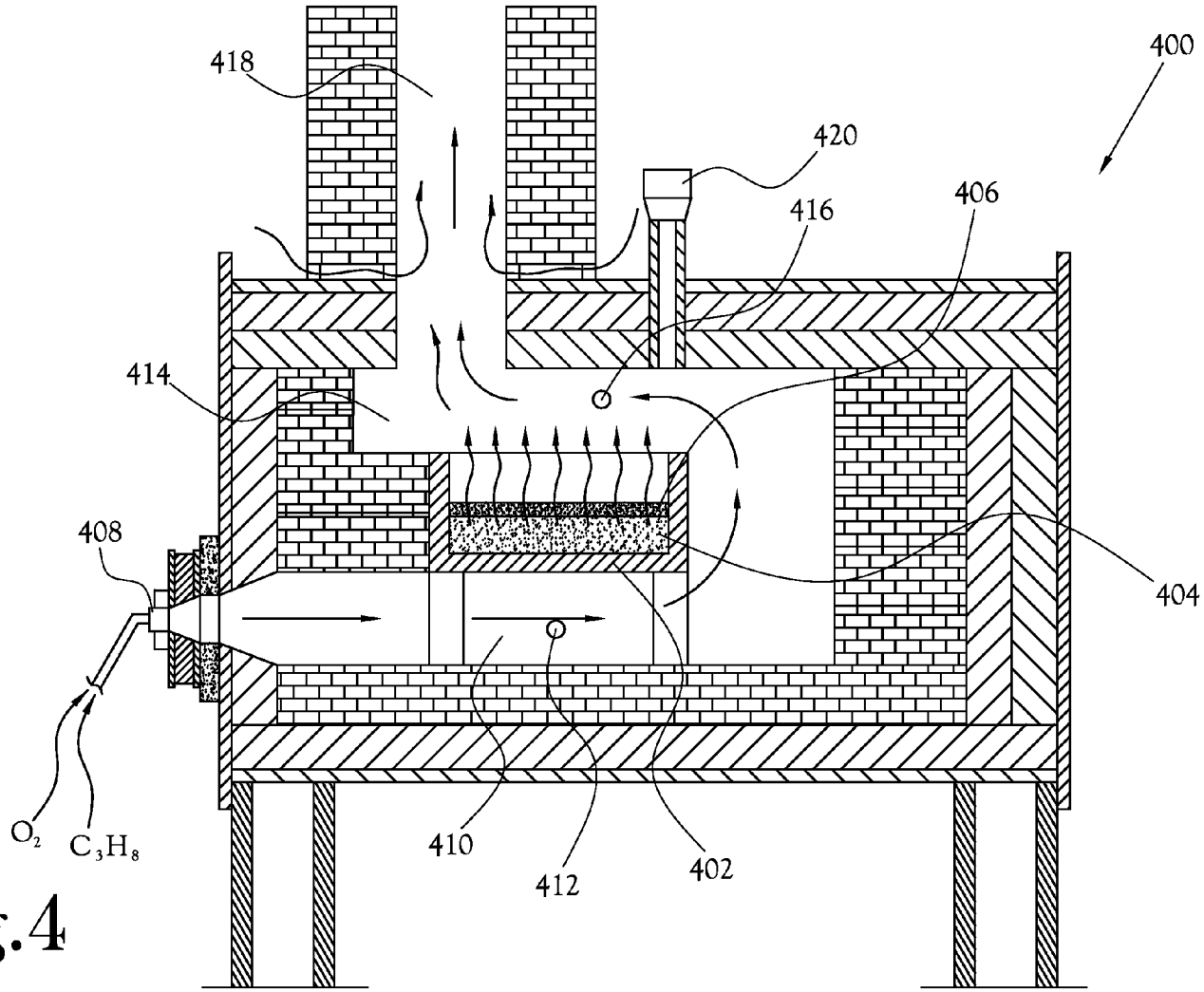
FIG. 4 depicts the fourth reactor designed and tested by the inventor in developing the present invention.

FIG. 4 depicts Reactor No. 4. The reactor 400 is lined with 1649° C. (3000° F.) insulating firebrick and refractory board material. A saggar 402 placed inside the reactor 400 holds the raw materials, i.e., coal 404 and iron rich feedstock 406, during the reduction process. A combustion source 408 heats the interior of the reactor 400 to the desired temperature. The heated air flow of Reactor No. 4 is designed such that the products of combustion flow through a lower heating channel 410 underneath the saggar 402, upward past a lower thermocouple 412, through an upper heating channel 414 above the saggar 402, and past an upper thermocouple 416 before exiting through the short firebrick stack 418. The stack 418 includes intake vents allowing additional air to be drawn into the stack. In one embodiment, the combustion source is a naturally aspirated, propane fueled 147 kW (500 000 BTU/h) weed burner. In one embodiment, the saggar is a hi-alumina refractory box having dimensions of 30.48 cm×20.32 cm×10.16 cm (12 in×8 in×4 in). A sight port 420 is provided to visually monitor the mill scale on top of the coal in the saggar.

Prior to light off, the saggar 402 is loaded with coal and topped with a layer of mill scale. Propane and induced air are used to quickly bring the reactor near operating temperature. Oxygen enrichment is supplied as needed to produce temperatures in excess of 1316° C. (2400° F.). Reactor No. 4 reaches 1204° C. (2200° F.) in approximately 45 minutes (heat-up) and oxygen is injected to reach a final operating temperature in the range of 1371° C. to 1427° C. (2500° F. to 2600° F.) both above and below the saggar. During heat up and operation, the coal off-gases volatile material, primarily $H_2$, $CH_4$, and CO. The coal volatiles provide a continuous stream of hot reductants, or reducing gas, up through the mill scale. After exiting the saggar, the reducing gas reacts with remaining oxygen (induced air) in the flue gas and light-off thereby maintaining the temperature of the upper heating channel 414 in the range 1315° C. to 1371° C. (2400° F. to 2500° F.), which is sufficient to melt the reduced iron.

The first material tested in Reactor No. 4 was mill scale. Mill scale is a mixture of iron oxides including FeO, $Fe_2O_3$, and $Fe_3O_4$ that is flaked off from hot iron as it is further processed through rolling mills. It is basically the oxides of the iron skin that appears on hot iron during the rolling process. Mill scale is a waste product of little or no economic value because it is a mixture of iron oxides, is wet, and is contaminated with oils and lubricants used in the rolling process. More importantly, mill scale is considered one of the most difficult of iron rich feedstock to reduce to metallic iron. Mill scale has a very high proportion of FeO so it is not easily reduced. Other researchers have noted that while mill scale has a very high iron content and low contaminant level, it is very hard to reduce because it has no porosity. It is normally sold to the cement industry and typically is priced less than $10 per metric ton. The mill scale sample used in Reactor No. 4 was from an electric arc furnace facility producing rebar and is very similar to other mill scales from rolling mills. It is basically a low carbon steel mill scale with 31.5% metallization (i.e., 68.5% of the iron is in an oxidized state). Moreover, FeO readily reacts with the silica in the refractory bricks used in a coke oven.

Run No. 1 was a short test run lasting 47 minutes and was stopped due to damage to the flue tile natural draft stack. The feed materials in the ceramic test box (saggar) were 313 g (0.69 lbs.) of as received mill scale and 667 g (1.47 lbs.) of metallurgical coal.

Run No. 2 was a full run lasting 83 minutes with a bed of 2041 g (4.5 lbs.) of metallurgical coal and 907 g (2.0 lbs.) of as received mill scale layered on top. After the cool down period lasting approximately 8 hours, reactor disassembly and sample recovery, Run No. 2 showed very promising results. The mill scale appeared to have reduced and melted, and upon cutting the sample, lustrous, magnetic and metallic pieces were found not only on top of the coke bed but also in the material that ran down into the fissures of the coke.

Run No. 3 was a split box test, meaning that half of the saggar was loaded with Mix No. 1 and the other half was loaded with Mix No. 2. A division panel of 1649° C. (3000° F.) Thermal Ceramics fiber board was used to separate the two sections. Mix No. 1 was a coal bed of 1488 g (3.28 lbs.) of fine Black Thunder PRB steam sub-bituminous coal with 826 g (1.82 lbs.) of as received mill scale layered on top. Mix No. 2 was a coal bed of 1197 g (2.64 lbs.) of metallurgical coal with 680 g (1.5 lbs.) of as received mill scale layered on top. Run No. 3 lasted 78 minutes with the temperature held above 982° C. (1800° F.) for 45 minutes. The results of Run No. 3 showed good signs of metallic production. Run No. 3 Mix 1 exhibited a moderate metallization (80%) with a slight increase in sulfur and carbon levels near the parent feedstock. Run No. 3 Mix 2 exhibited a relatively low metallization (69%) with substantially reduced carbon content and increased sulfur content. These results were surprising, especially the lower metallization and substantial decrease in carbon. It should be noted that PRB coal has a very high volatile matter content and lower sulfur compared to the metallurgical coal. Possibly, the higher volatile matter content led to enhanced metallization. Actual sulfur release from PRB coal is unknown because it is not normally processed in a devolatilization (coking) mode.

Run No. 4 was also a split box test. For this test run, the mill scale was size reduced and screened to 100% minus 0.8 mm and limestone was added to each mixture for sulfur reduction. Mix No. 1 was 680 g (1.5 lbs.) of finely ground PRB coal having a mass fraction of 0.1, pulverized limestone with a mass fraction of 0.01, and minus 0.8 mm mill scale having a mass fraction of 0.89. Mix No. 2 was 680 g (1.5 lbs.) of minus 0.8 mm mill scale having a mass fraction of 0.99 and pulverized limestone with a mass fraction of 0.01. Both mixes were placed on top of a coal bed of 907 g (2.0 lbs.) of metallurgical coal. Run No. 4 lasted 94 minutes with the temperature above 982° C. (1800° F.) for 59 minutes. After cool down and reactor disassembly, the results of Run No. 4 showed very good signs of iron/steel product production. Run No. 4 Mix 1 exhibited moderate metallization (76%) and a moderate sulfur level. A substantial decrease in carbon content was observed but cannot be easily explained. Run No. 4 Mix 2 showed unheard of metallization of 99%, a low carbon content, and a moderate to high sulfur content. It is speculated that the addition of limestone to mixtures in Run No. 4 trapped sulfur from the reducing gas stream emanating from the coal bed and the higher sulfur levels resulted from the formation of calcium sulfide (CaS) when the liquid iron/steel product captured gaseous sulfur (probably in the form of $H_2S$).

TABLE 1

Sample analysis results for mill scale feedstock and products of Runs No. 3 and 4

| Sample ID | Total Fe (%) | Metal Fe (%) | Fe++ (%) | C (%) | S (%) | Metallization (ISO-5416) (%) |
|---|---|---|---|---|---|---|
| Mill scale | 76.20 | 24.00 | 36.92 | 0.173 | 0.047 | 31.5 |
| Run #3 Mix 1 | 90.09 | 72.45 | 16.88 | 0.140 | 0.098 | 79.7 |
| Run #3 Mix 2 | 86.67 | 59.89 | 23.48 | 0.031 | 0.176 | 69.1 |
| Run #4 Mix 1 | 87.63 | 66.43 | 13.74 | 0.040 | 0.139 | 75.8 |
| Run #4 Mix 2 | 95.00 | 94.34 | 1.94 | 0.059 | 0.255 | 99.3 |

The level of metallization achieved in Run No. 4 using mill scale as the iron rich feedstock establishes the simultaneous process as a proven ironmaking process. From the testing and results described herein, one skilled in the art will appreciate that the simultaneous process would be at least as effective, and predictably more effective, when applied to an iron rich feedstock that is more easily reducible, such as iron ore fines (hematite or magnetite). Moreover, the iron/steel product produced from the simultaneous product is a metallic like material capable of standing up to the rigors of shipping and to the physical requirements of a blast furnace feedstock because the iron/steel product is allowed to both reduce and melt. Once a metallic iron has been melted and subsequently cooled, it becomes highly resistant to breakage or abrasion. This gives the simultaneous process an advantage over similar processes used to produce iron ore pellets, sinter, or direct reduced iron where the end product is only heated enough to fuse the material but not fully melted.

Reactor No. 4 established that a high quality iron/steel product can be produced using what are currently the two lowest cost raw materials: non-metallurgic coal and mill scale. The conditions present in Reactor No. 4 are highly desirable for producing an iron/steel product. Specifically, Reactor No. 4 provides a suitable combination of time, temperature, reducing atmosphere, and isolation from refractory materials degraded by the iron reduction process. The conditions achievable with Reactor No. 4 were the conditions needed to produce pig iron from low cost feed stocks as originally planned by the inventor when research started in early 2007. The following discussion describes the conditions occurring in Reactor No. 4 that contributed to the success and effectiveness of the simultaneous process.

First, Reactor No. 4 allowed reduction times on the order of tens of minutes sufficient to accomplish the desired reduction. The reduction of iron oxides by a reductant gas is severely limited by the porosity and pore size of the oxide. Each oxide and/or ore/mill scale has its own porosity and pore size which limits the gaseous diffusion of reductant gases into the interstices of the oxide. In the earlier reactors designed by the inventor, the iron oxides quickly melted and passed through the frit effectively escaping from the reducing atmosphere before reduction was complete. In the first three reactors tested, the iron rich feedstock sometimes melted before a complete reduction could occur and a mixture of oxide/partially reduced oxide/metallic iron was produced as well as slag and iron/slag mixtures. In contrast, even after melting occurs, the design of Reactor No. 4 keeps the iron oxides in the reducing atmosphere for as long as need to complete reduction.

Second, Reactor No. 4 achieves and maintains a suitable temperature range of 1316° C. to 1398° C. (2400° F. to 2550° F.) to accomplish the desired reduction. The melting temperature for iron oxides 1200° C. to 1427° C. (2192° F. to 2600° F.) is higher than the melting temperature of reduced irons 1538° C. to 1565° C. (2800° F. to 2849° F.). In order to insure reduction before melting, the temperature of the oxide must remain below the melting temperature of the oxide but above the melting temperature of the reduced iron. If the temperature is too hot, the oxide melts and does not reduce or partially reduces. If the temperature is too low, reduction takes place but melting does not. In contrast to the co-current and countercurrent designs of the earlier reactors, the air flow and layout of Reactor No. 4 allows sufficient control to maintain the correct temperature range around the iron oxide.

Third, Reactor No. 4 provides a strong reducing atmosphere capable of completely reducing even the most reduction resistant iron oxides. When bathed in a strong reducing atmosphere, iron oxides reduce to metallic iron. The stronger the reducing atmosphere the faster the reduction. The devolatilizing coal bed in Reactor No. 4 provides a reducing atmosphere of almost pure $H_2/CH_4/CO$. "Hot" hydrogen ($H_2$) is a superior reducing agent because the small size of the $H_2$ molecule allows penetration into the smallest of pore sizes in iron oxides. The impact of the reducing capability of the other coal volatiles, namely, $CH_4$ and CO cannot be ignored as they too, at sufficient temperatures, are strong reducing agents. Reactor No. 4 demonstrates that reduction of iron oxides normally considered difficult to reduce (i.e., mill scale) is complete and efficient. The test results indicate that the fastest and best reduction occurred with non-metallurgic coal, such as Powder River Basin (PRB) coal, probably because of its high volatile material content leading to a higher concentration of reductant gas flowing through the mill scale layer. The ability to completely reduce mill scale demonstrates the effectiveness of the reducing atmosphere provided by Reactor No. 4.

Fourth, Reactor No. 4 provides the necessary isolation from refractory materials. In retrospect, this condition seems trivial to achieve, however, the first three reactors tested by the inventor failed to achieve this condition. When heated to a temperature in range of 1316° C. to 1398° C. (2400° F. to 2550° F.), the coal bed devolatilizes into either coke (from metallurgical coal) or char (from non-metallurgic coal). The devolatilized coal cake is a carbonaceous material. Carbon is a highly effective container for reducing iron oxides because it is not severely impacted by hot FeO, $Fe_2O_3$, $Fe_3O_4$, or the resulting iron/steel product. Instead, the heat merely dissolves a little of the carbon into the iron/steel product. Unless shielded from refractory materials, the iron/steel product would react with the refractory materials and re-oxidize.

After considering the test results, the inventor realized that the conditions produced in Reactor No. 4 were similar to the conditions that occur on the surface of the coal bed in a non-recovery or heat recovery coke oven. The simultaneous process is implemented in a non-recovery or heat recovery coke oven and successfully reduces a wide variety of iron rich feedstock including many normally considered to be undesirable due to low blast furnace productivity. The iron rich feedstock suitable for use in the simultaneous process include, but are not limited to, mill scale, electric arc furnace dust (after thermal treatment to remove and recover zinc), hematite fines, magnetite fines, blast furnace dust, blast furnace sludge, basic oxygen furnace dust, basic oxygen furnace sludge, and oily mill scale. While the iron/steel product produced using the simultaneous process varies based on the iron rich feedstock used, the iron/steel product typically ranges in grade from pig iron to ultra-low carbon steel. Further, the iron/steel product produced during the simultaneous process can include more than one grade of iron or steel. When performed using a heat recovery coke oven, the simultaneous process also produces energy from waste heat recovery.

Figure 5:
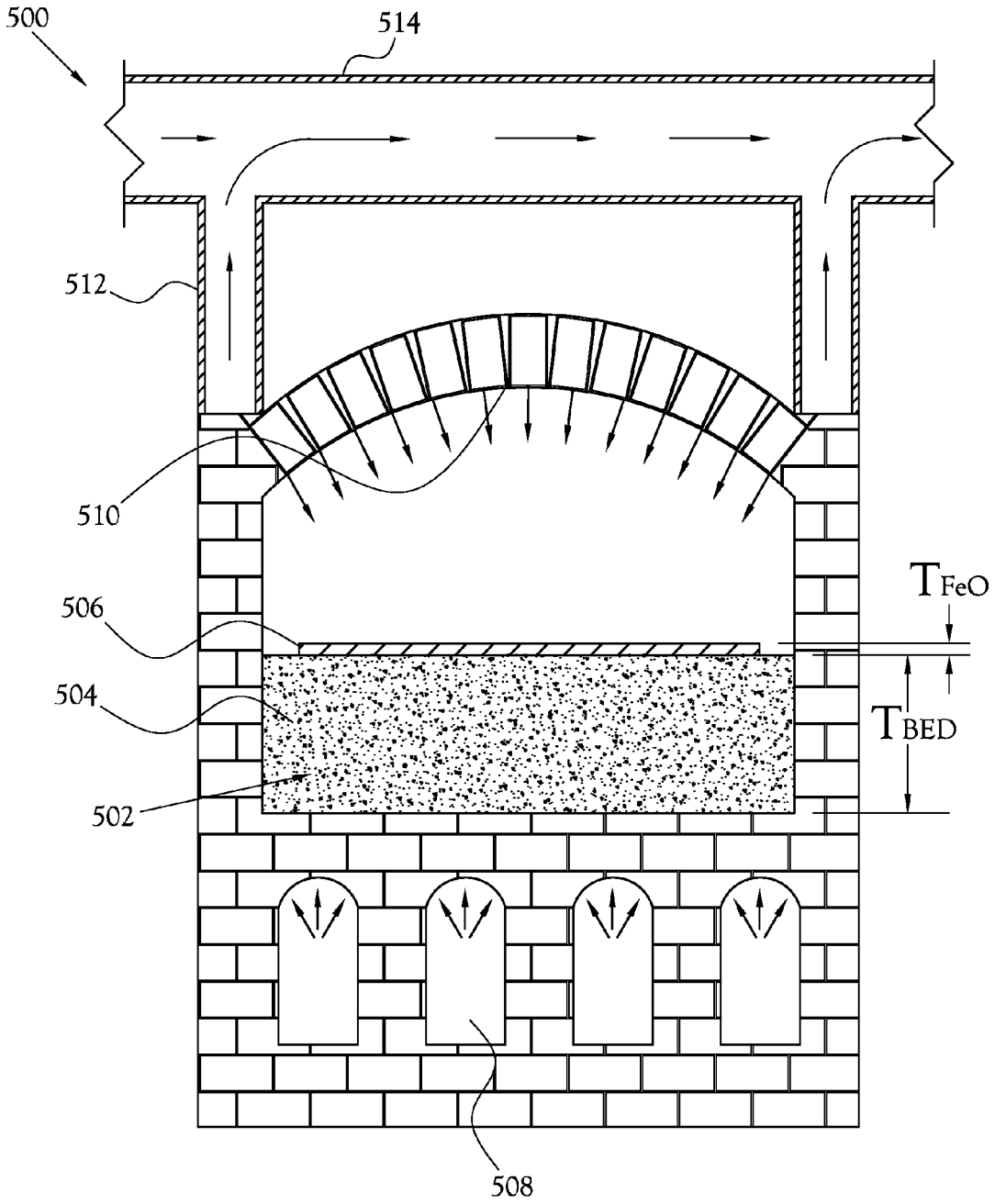
FIG. 5 illustrates a heat recovery coke oven at the beginning of the simultaneous process.

FIG. 5 illustrates a heat recovery coke oven 500 performing one embodiment of the simultaneous process at the beginning of the simultaneous process. A bed 502 of coal 504 topped with a layer of iron rich feedstock 506 is charged into the coke oven 500. In one embodiment, the simultaneous process uses a bed with a well-defined flat surface. In a conventional coking process, sole flues 508 heat the bed from the underside and radiant heat reflected by the oven crown 510 heats the top of the bed. In other words, both the top and the bottom of the bed are coked simultaneously. Heated air is from the heat recovery coke oven 500 is collected by uptake vents 512 and channeled into the waste heat tunnel 514 for heat/energy recover. The length of the coking cycle (i.e., the time period required to convert metallurgical coal into metallurgical coke) is dictated by the multiple phase changes that occur in the coking process namely solid (coal) to liquid (tar) and back to solid (coke) as well as the poor heat transfer through coke due to its 50% porosity. Non-recovery or heat recovery coke making is a batch process with a normal coking cycle in the range of 24 hours to 72 hours. In the United States, typical coking cycles are approximately 48 hours. The thickness $T_{BED}$ of the coal bed 502 is related to the length of coking cycle. More specifically, the bed thickness $T_{BED}$ is selected to allow the coal to completely devolatilize into coke during the coking cycle. Using a coking cycle lasting approximately 48 hours as an example, the initial thickness of the bed is approximately 102 cm (40 in). The bed thickness can be estimated by adding 1 inch for every hour of shorter coking cycles (i.e., 30 hours or less) and 0.8 inch for every hour of longer coking cycles (30 hours or more).

In one embodiment of the simultaneous process, the iron rich feedstock is layered on top of the coal bed to a thickness $T_{FeO}$ in the approximate range of 1.9 cm to 2.2 cm (0.75 in to 0.875 in) or, alternatively, 1.9 cm to 5.1 cm (0.75 in to 2 in). The maximum thickness of the iron rich feedstock is limited because a layer of iron rich feedstock that is too thick restricts the radiant heat from reaching the top of the bed and results in slower devolatilization of the bed. This would materially increase the length of the coking cycle or cause incomplete devolatilization of the coal bed.

Figure 6:
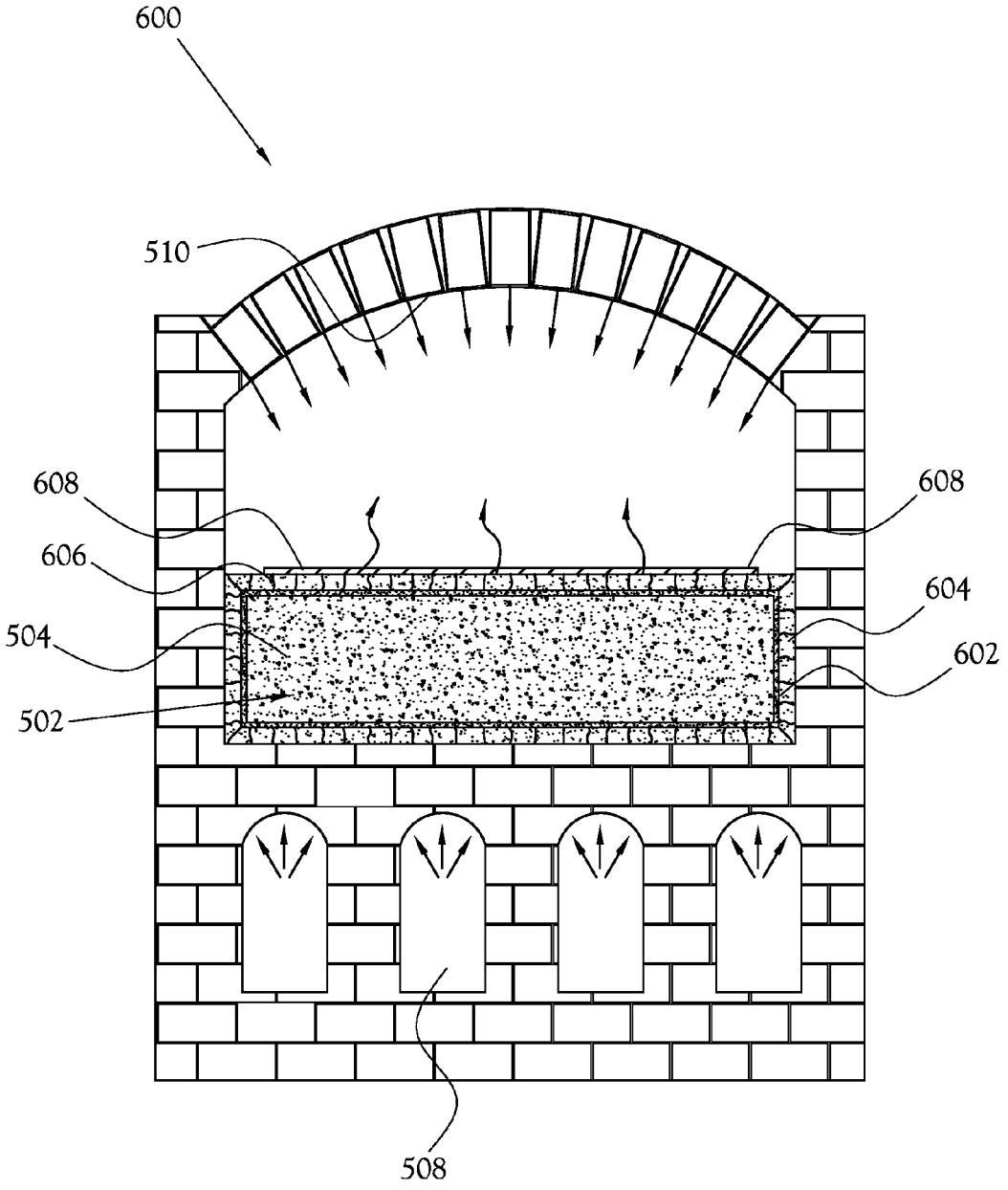
FIG. 6 illustrates a non-recovery coke oven approximately four hours into the simultaneous process.

FIG. 6 illustrates a non-recovery coke oven 600 approximately four hours into the simultaneous process. The non-recovery coke oven omits the uptake vents 512 and waste heat tunnel 514 but is otherwise identical to the heat recovery coke oven of FIG. 5. At this point in the simultaneous process, the bed 502 has begun devolatilizing and off-gassing the volatile materials (i.e., the reducing gas). As it devolatilizes, a portion of the bed 502 changes to a liquid and forms a tar seam 602. As the devolatilization process continues, the liquid portion of the bed 502 returns to a solid in the form of coke 604. As a result of the shrinkage of the bed during the devolatilization process, a series of cracks 606 form in the bed 502. The reducing gas passing through and surrounding the iron rich feedstock 608 causes reduction of the iron oxides to occur. As the oxides are removed from the iron rich feedstock 608 and the iron rich feedstock 608 melt, the thickness $T_{FeO}$ diminishes.

Figure 7:
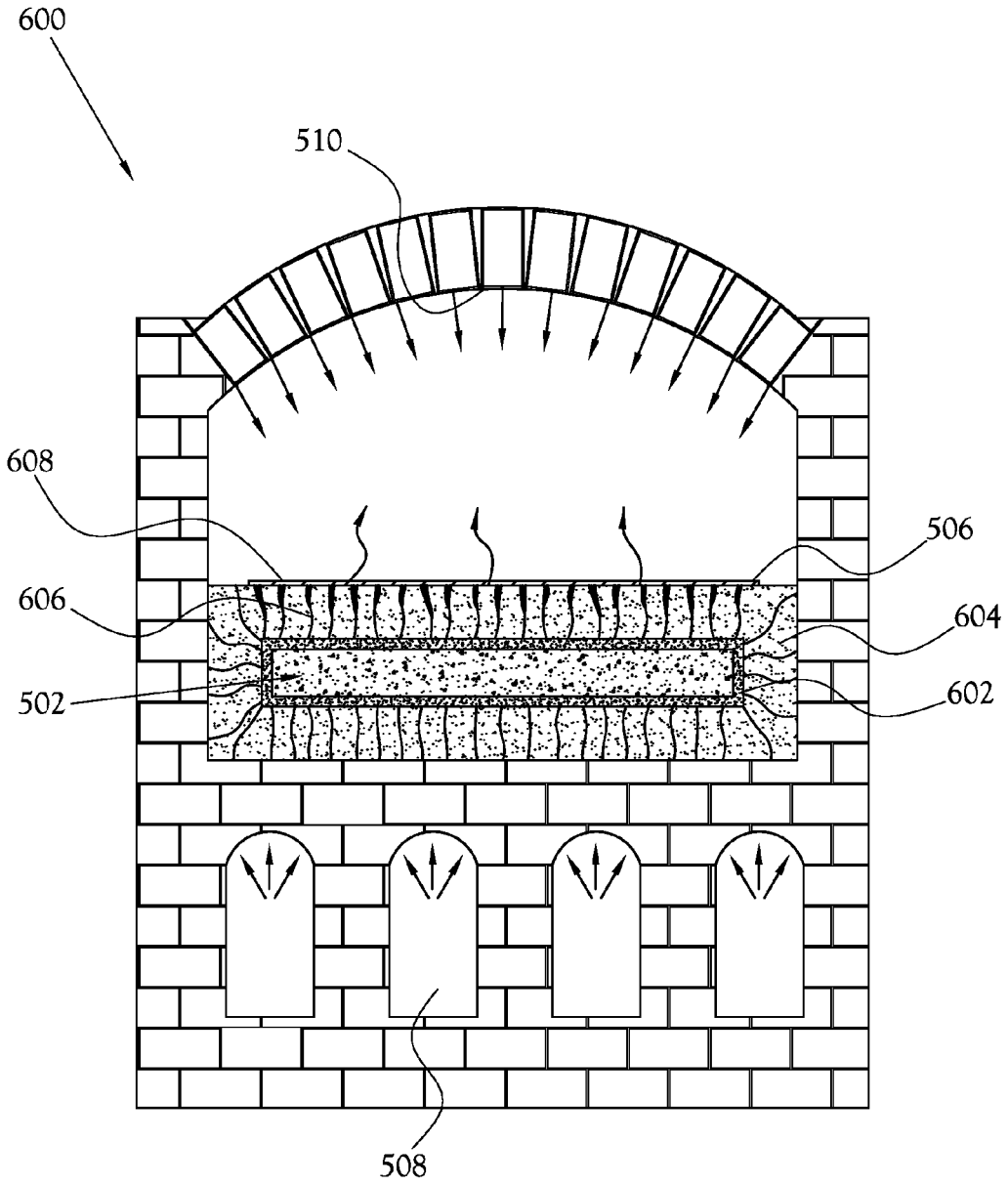
FIG. 7 illustrates the coke oven of FIG. 6 approximately 24 hours into the simultaneous process.

FIG. 7 illustrates the non-recovery coke oven 600 of FIG. 6 approximately 24 hours into the simultaneous process. At this point, more of the bed 502 has completed devolatilization. Larger cracks 606 have appeared and some of the molten iron/steel product 608 has flowed into the cracks 606.

Figure 8:
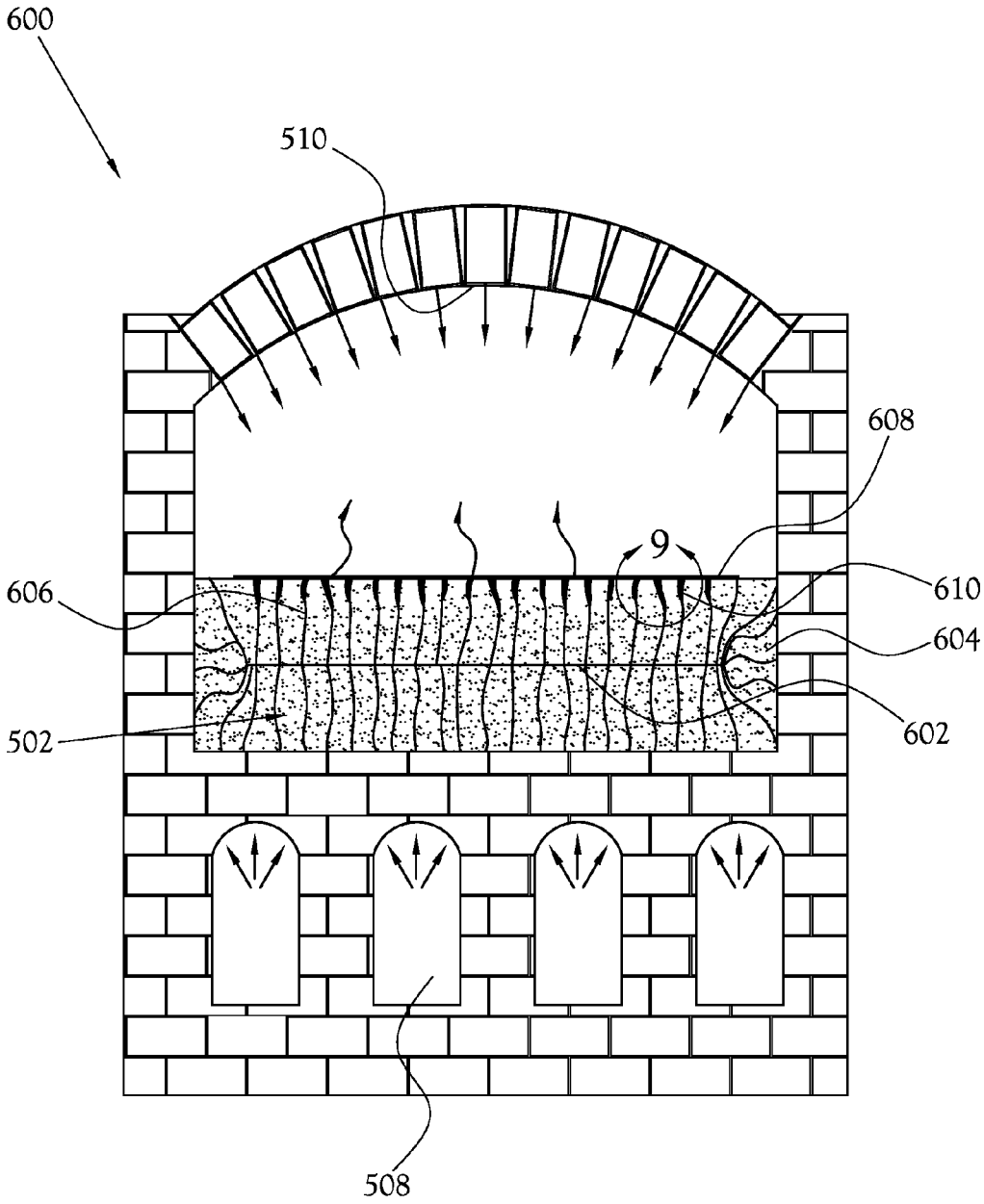
FIG. 8 illustrates the coke oven of FIG. 6 approximately 48 hours into the simultaneous process.

FIG. 8 illustrates the non-recovery coke oven 600 of FIG. 6 at the conclusion of the simultaneously process. In the illustrated embodiment, the conclusion of the simultaneous process is considered to be approximately 48 hours after it begins based on typical coking cycle lengths in the United States. At this point, the bed 502 has completely devolatilized. Most of the molten iron/steel product 608 has flowed into the cracks 606.

Figure 9:
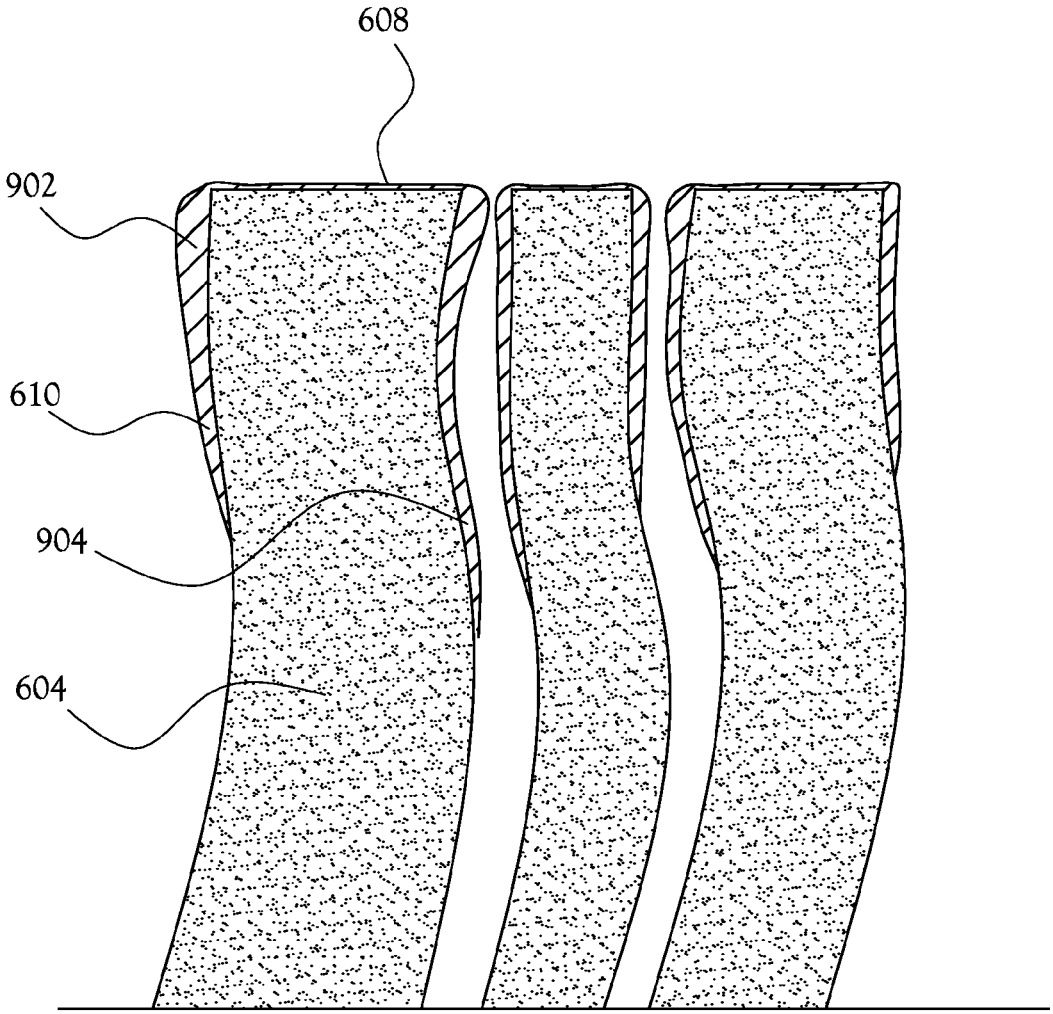
FIG. 9 is an inset view of the bed of FIG. 8 showing the iron/steel product at the conclusion of the simultaneous process in greater detail.

FIG. 9 illustrates an inset view of the bed in FIG. 8 illustrating the iron/steel product. The iron/steel product on or near the surface of the bed 902 tends to be of a lesser grade than the iron/steel product found in the cracks 904. It is speculated that the grade difference is due the surface iron/steel product 902 being exposed to the ambient atmosphere of the coke oven which is likely to be somewhat less concentrated than the reducing gases being off-gassed and passing upwards through the cracks around the lower iron/steel product 904. Further, it is likely that the higher temperatures of the bed and the surface iron/steel product 902 results in reactions between the coke and the iron/steel product that slightly increases the carbon content.

The simultaneous process offers sufficient residence time for the reactions to reduce iron oxide to an iron/steel product. Based on the results of testing in Reactor No. 4, a 48 hour coking cycle is approximately 50 times longer than is required for complete reduction. Because of the coking cycle lengths that coke plant operators have found to be optimal for coke production, the simultaneous process provides an extremely long time for reduction reactions to occur. Pilot plant operations in Reactor No. 4 demonstrated results of 99% metallization of mill scale in as little as 94 minutes, which includes the approximately 60 minutes required to reach reduction temperatures of 1800° F. Unfortunately, in order to achieve the desired results and efficiencies of the simultaneous process, significantly longer times are necessary to produce both coke and the iron/steel product.

The temperatures that occur on top of the bed in the coke ovens during the simultaneous process are generally in the range of 1301° C. to 1460° C. (2375° F. to 2660° F.). Reduction begins to occur at temperatures of approximately 982° C. (1800° F.) and reaction rates increase at higher temperatures. The melting points of steels and reduced irons range between 1200° C. to 1427° C. (2192° F. to 2600° F.). Iron oxides typically melt at temperatures above 1538° C. (2800° F.). Accordingly, the temperatures in a coke oven are sufficient to accelerate the reduction reactions and to melt the iron.

As the concentration of reducing gases increases, the reduction reactions occur at a faster pace. In conjunction with the long coking times, the thick coal/coke bed continues to devolatilize and release the reducing gases into the coke oven. The gases emanating from the bed in a coke oven are essentially pure reducing gases ($H_2$/$CH_4$/CO). The composition of the atmosphere above the coal/coke bed by typical volume fraction (concentration) is 41% $H_2$, 19% $CH_4$, and 6% CO. The relatively high percentage of hydrogen devolatilized during the coking process is beneficial to the simultaneous process because the small size of the $H_2$ molecule makes it one of the most effective reductants. As a result, the simultaneous process continuously surrounds the iron bearing material with a highly effective, high concentration of heated reducing gases.

In a coke oven, the coal devolatilizes into carbon with ash volume fraction of approximately 5% to 9%. As previously discussed, containment of the iron oxides and the reduced iron was a continual source of problems in the tests of the first three reactors. Containment refers to using a material or structure that that does not react with and is not destroyed or severely degraded in the presence of molten $Fe_2O_3$, $Fe_3O_4$, FeO, or Fe plus slag. The aggressive nature of molten iron and iron oxides is well known in the ironmaking industry particularly based on the experiences of blast furnace operators. The coal\coke bed of the simultaneous process serves to isolate the molten iron and iron oxides from the refractory materials of the coke oven, which would be severely damaged by contact with the molten iron and iron oxides. If the carbon interacts with the molten iron or iron oxides, it simply affects the quality of the resulting product by increasing the carbon content (i.e., producing high carbon pig iron).

The simultaneous process provides two basic mechanisms that prevent the molten metal from coming in contact with the refractory materials of the coke oven. First, the bed has a steeply declining temperature gradient from the outer surface to the middle. As a result, molten metal cools significantly as it runs deeper into the cracks formed in the bed until it solidifies. The inventor found that the molten metal typically flows only a matter of inches into the cracks before solidifying. Second, as described above, the coking process changes coal (a solid) into tar (a liquid) before it changes into coke (a solid). The tar seam begins at the perimeter of the bed and slowly moves inwardly during the coking cycle. At the conclusion of the coking cycle, the tar seam is located approximately midway through the thickness of the bed. The tar seam serves as an additional barrier that prevents the molten metal from passing through the bed to the underlying refractory materials.

As previously discussed the melting point of iron rich feedstock is approximately 1538° C. (2800° F.). A rather steep temperature gradient exists in the coke bed following the heating cycle, as shown in FIG. 8. While the surface temperature of the bed remains around 1427° C. (2600° F.), the temperature midway through the bed is approximately 1093° C. (2000° F.) with an average bed temperature of approximately 1232° C. (2250° F.). Because surface temperature of the bed is greater than the melting point of pig iron, the molten iron/steel product formed on top of the bed flows a short distance (typically a matter of inches) down into the coke bed until it encounters a coke temperature lower than melting point of the iron/steel product at which point the molten iron/steel product freezes (solidifies) and does not penetrate any further into the coke bed.

In any large industrial coke, iron, and power facility it would be necessary to separate the coke from the iron rich feedstock. A brief description of coke handling, especially in a heat recovery coke plant is given below.

Figure 10:
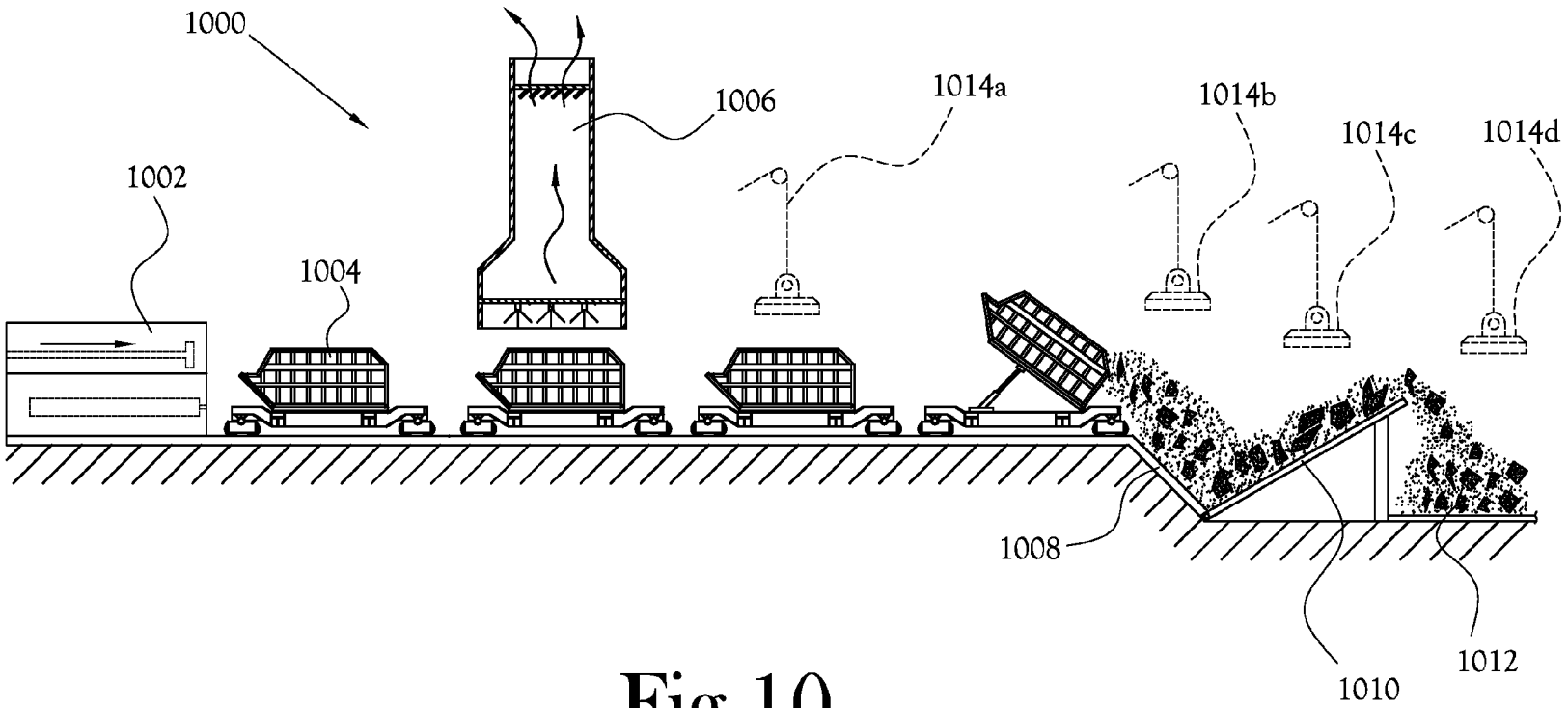
FIG. 10 illustrates the separation of the iron/steel product from the coke product during post coking handling.

FIG. 10 is a schematic diagram of the general process 1000 of handling hot coke illustrating the separation of the iron/steel product from the coke product. Most heat recovery coke plants in the U.S., India, and China handle hot coke in a very similar fashion. Hot coke is pushed out of the coke oven 1002 into a flat push hot car 1004. The elevation of the bed of the flat push hot car 1004 and the floor of the coke oven 1002 is the substantially the same which means that the coke cake and the iron/steel product remain relatively undisturbed. The flat push hot car 1004 transports the coke to a quench tower 1006 that douses the incandescent coke with 37.9 kl to 56.8 kl (10

000 gal. to 15 000 gal.) of water to cool it. Next, the flat push hot car 1004 carries the cooled coke cake to a coke wharf 1008, where the coke is dumped onto a refractory lined incline. At this point, the coke cake breaks up and the iron/steel product becomes intermingled with the coke. From the coke wharf 1008, the coke is metered onto a belt conveyor 1010 for transport to a destination location 1012 for processing, storage, use, and/or transport to a remote facility (screening station, onsite stock pile, blast furnace, or rail car station).

During the post-coking handling, the iron/steel product is optionally separated from the coke at one or more of several different locations. One technique uses an electromagnet to separate the iron rich feedstock from the coke. Once separated, the electromagnet deposits the iron/steel product at a collection site for processing, storage, and/or transport. Because the iron/steel product is magnetic and the coke is not, separation is efficient, timely, and nearly 100% complete. Any fractional cross-contamination (coke in the iron/steel product or iron/steel product in the coke) does not materially impact the economic value of the iron/steel product or the coke. For example, if the iron/steel product went to an electric arc furnace, carbon (i.e., coke) is normally added to the melt. In a blast furnace, both iron and coke are charged. Separation allows the producer to sell the iron/steel product and the coke to blast furnace operators or to electric arc furnace operators depending on market conditions or to independently sell the iron/steel product and the coke.

In one embodiment of the separation step, the flat push hot car 1004 stops between the quench tower 1006 and the coke wharf 1008. An electromagnet 1014*a* moves over the flat push hot car 1004 and separates the magnetic iron/steel product from the non-magnetic coke. In another embodiment, an electromagnet 1014*b* deployed above the coke wharf 1008 removes the iron/steel product from the coke. In a still further embodiment, an electromagnet 1014*c* removes the iron/steel product from the coke as it is carried by the belt conveyor 1010. In yet another embodiment, an electromagnet 1014*d* removes the iron/steel product from the coke at the destination location 1012 (i.e., from the stockpile, rail car, screening station). In some embodiments, an overhead crane or other conveyance system typically supports and moves the electromagnet. In other embodiments, a stationary electromagnet system is suitable. For example, a stationary electromagnetic between the quench tower and the coke wharf can collect the iron/steel product from the flat push hot car and deposit the iron/steel product in a mobile container positioned under the electromagnetic after the flat push hot car continues on to the coke wharf.

Based upon the best available figures from a presentation given at Euro-Coke 2008 by Binay Singh of Tata Steel, approximately 6.5% of the annual world production of coke is produced in non-recovery or heat recovery coke ovens. In 2008, worldwide annual coke production was 542 million metric tons, of which approximately 35 million metric tons are attributable to non-recovery and heat recovery coke ovens Annual coke production for each square foot of the floor area of the coke oven is approximately 9 metric tons in a low temperature coke oven and in the range of 9.5 to 9.7 metric tons in a high temperature coke oven. The floor area of the coke oven corresponds to the surface area of the top surface of the bed. Assuming a little over 9 metric tons of annual coke production per square foot, the total available area in non-recovery and heat recovery coke ovens is approximately 4 million square feet ($4\times10^6$ ft$^2$), or nearly 92 acres of very valuable real estate.

Annual coke production in a typical heat recovery coke plant ranges from 500 000 metric tons ($0.5\times10^6$ T) to 1 600 000 metric tons ($1.6\times10^6$ T). Conservative estimates of the iron/steel product yielded by the simultaneous process for each coking cycle are between 3 metric tons and 10 metric tons and could be increased substantially if the economics favor iron/steel product production over coke production. This equates to an annual iron/steel product production per square foot of between 1.1 metric tons and 3.65 metric tons. If adopted worldwide, annual iron/steel product production using the simultaneous process would be between 4.4 million metric tons ($4.4\times10^6$ T) and 15 million ($15\times10^6$ T). Assuming a mill scale price of $10 per metric ton, a pig iron price of $400 per metric ton, and a shipping cost of $25 per ton, the cost of raw material is $35 per ton and the value of the product is $375 per ton. The net profit per ton of the iron/steel product produced using the simultaneous process is $340 per ton leading to annual worldwide revenues from $1.5 billion to over $5.0 billion.

As discussed above, furnace productivity is a concern for blast furnace operators. Accordingly, controlling the size and shape (i.e., specific surface are) of the iron/steel product has significant value by producing a product that improves blast furnace productivity. Coupled with the fact that the iron/steel product is pre-reduced, blast furnace efficiency can be drastically improved. Although less critical to electric arc furnaces operations, control over the specific surface area and degree of reduction aids in the tap-to-tap times.

Numerous combinations of sizes and shapes for the iron/steel product are available and are selected to improve the blast furnace productivity. For blast furnace operations, the shape selected should be strong so as to resist degradation (fines generation) as the iron bearing material and coke (furnace burden) descends down from the stack region to the cohesive zone. Some of the available shapes that would be suitable for improving blast furnace productivity include rings, cylinders, half cylinders, hemispheres, truncated prisms, pyramids, cubes, and waffle. Ring shapes include the Raschig Ring, a hollow cylinder with the length being equal to the outside diameter. The Raschig Ring shape is known to have a high resistance to breaking. One skilled in the art will appreciate that shapes such as those listed above have lower pressure drop characteristics compared to pellets/spheres.

The majority of heat recovery coke ovens outside the United States utilize a practice called stamp charging for the bed. Stamp charging refers to the industrial practice of compacting the coal into a cake with a density of approximately 1009 kg/m$^3$ to 1089 kg/m$^3$ (63 lb/ft$^3$ to 68 lb/ft$^3$). This cake is then charged into the coke oven on a charging plate. The charging plate withdraws from the heat recovery oven leaves the coal cake in the coke oven for coke production. After charging, the bed or cake has a smooth, flat top surface.

Figure 11:
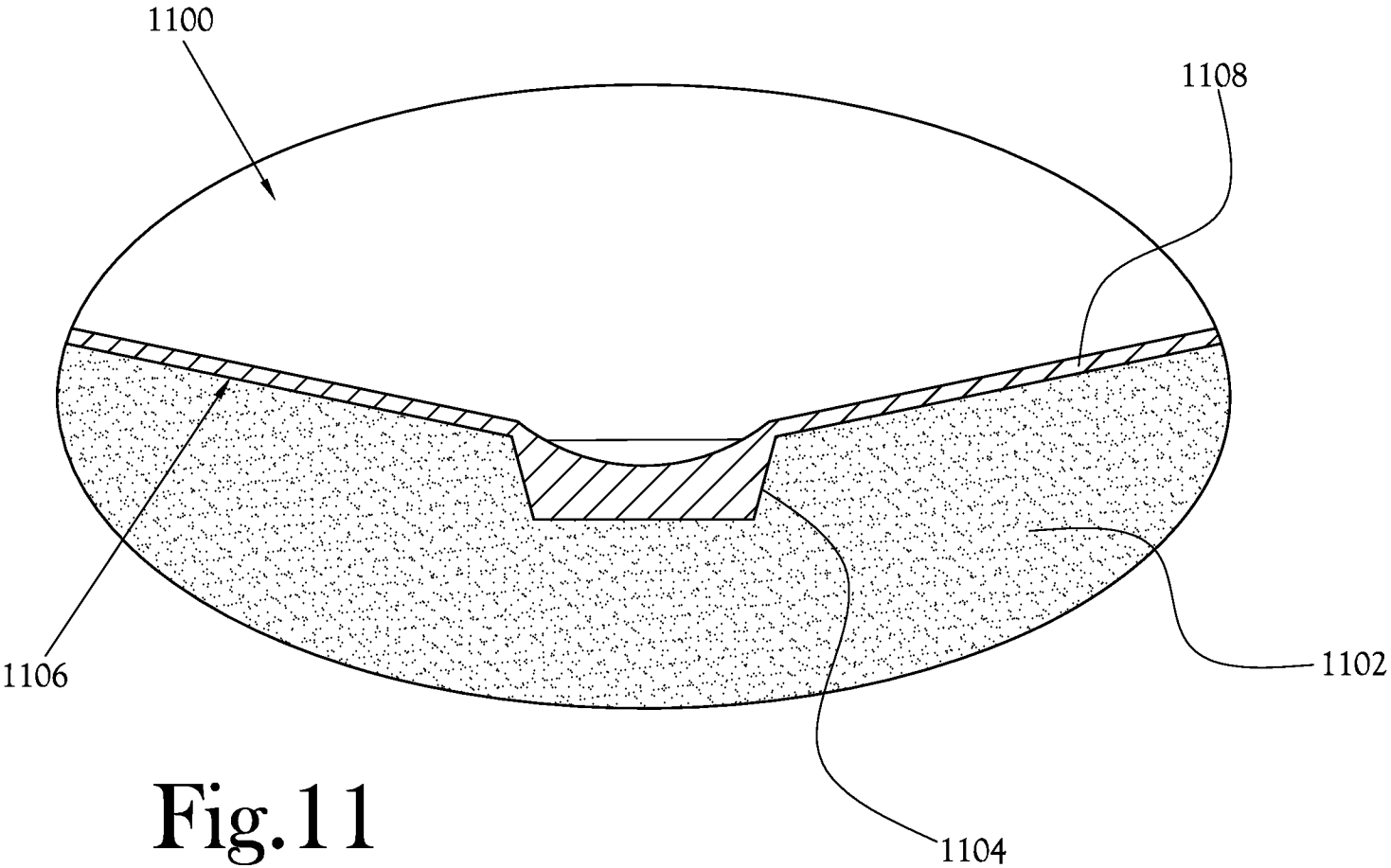
FIG. 11 illustrates one embodiment of a mold formed in a coal bed for creating an iron/steel product of a selected size and shape.

FIG. 11 illustrates one embodiment of a mold 1100 formed in the bed 1102 for creating an iron/steel product of a selected size and shape. To control the size and shape of the iron/steel product, the simultaneous process creates a plurality of cavities 1104 of the desired shape in the top surface of the bed 1102 during the stamp charging process. In one embodiment, the cavities are formed by passing a roller with protrusions in the desired shape over the top surface of the bed. In another embodiment, the plate compacting the bed defines the mold pattern that is pressed in to the top surface of the bed as it is being compacted.

Before continuing, it is important to understand the obstacles to creating a shaped iron/steel product. Unlike an injection molding processes, there is no pressure to force the motel metal into the mold cavities. Moreover, as the iron bearing raw material reduces, it occupies less volume. If the mold consisted only of cavities, the reduced volume and other factors such as surface tension and resistance to movement resulting from the flat top surface of the bed would hinder the filling of the cavities. These problems are clearly evident from the disclosure of the '718 patent. To overcome these obstacles, each mold cavity 1104 is surrounded by a sloped region 1106. The sloped region 1106, in combination with gravity, directs the molten metal 1108 into the mold cavities 1104, substantially filling the cavities. The diameter of the sloped region 1106 is selected to direct a sufficient volume of the iron/steel product to substantially fill the cavity into each mold cavity 1104.

The simultaneous process described herein provides numerous benefits. Many high temperature, fuel intensive processes such as coke making and iron making have $CO_2$ by-products (i.e., greenhouse gases) to which one must be sensitive. Because all of the $CO_2$ emitted by the simultaneous process is attributable to coke production, the production of the iron/steel product and the optional production of power is $CO_2$ free. Accordingly, the simultaneous process produces coke, an iron/steel product, and, optionally, energy, with no net impact on greenhouse gas accounting over the production of coke alone.

A simultaneous process for producing coke, an iron/steel product, and, optionally, energy has been shown and described herein. The simultaneous process is unknown, innovative, and practical. It provides significant production gains and economic gains for steel producers and non-recovery or heat recovery coke producers.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

What is claimed is:

1. A process for simultaneously producing reduced iron from iron rich wastes and metallurgical coke from metallurgical coal, said process comprising the steps of:

placing a layer of feedstock containing iron oxides on a top surface of a bed of metallurgical coal;

placing said bed of coal containing iron oxides into a coke oven selected from the group consisting of non-recovery coke ovens and heat recovery coke ovens;

maintaining said coke oven at a reduction temperature for a selected cycle time, said reduction temperature being a temperature sufficient to reduce said iron oxides into reduced iron and to devolatilize said coal in said bed into coke;

providing a reducing gas in said coke oven during said selected cycle time, said reducing gas being a gas that causes said iron oxides to reduce to reduced iron at said reduction temperature;

heating said coke oven to a melting temperature greater than the melting point of said reduced iron and below the melting temperature of iron oxide so that the melted iron flows down into the coke bed a matter of inches to a point wherein the reduced iron solidifies, which point protects the reduced iron from reoxidation and wherein the reduced iron is not in contact with underlying refractory materials;

removing said bed and said reduced iron from said coke oven while keeping said bed substantially intact;

cooling said bed and said reduced iron to a temperature sufficient to solidify said reduced iron; and recovering a metallurgical coke product and a reduced iron product from the coke ovens, wherein the reduced iron product has a metallization of greater than 95 wt. %.

2. The process of claim 1 characterized in that said feedstock is selected from the group consisting of mill scale, hematite fines, magnetite fines, blast furnace dust, blast furnace sludge, basic oxygen furnace dust, basic oxygen furnace sludge, oily mill scale, and thermally treated electric arc furnace dust.

3. The process of claim 1 characterized in that said reducing gas consists essentially of $H_2$, $CH_4$, and CO.

4. The process of claim 1 characterized in that said reducing gas is a byproduct of devolatilizing said coal in said bed.

5. The process of claim 1 characterized in that said iron oxides consists essentially of FeO, $Fe_2O_3$, and $Fe_3O_4$.

6. The process of claim 1 wherein said reduction temperature is ranges from about 760° C. (1400° F.) to about 1648° C. (3000° F.).

7. The process of claim 1 wherein said reduction temperature is ranges from about 1316° C. (2400° F.) to about 1398° C. (2550° F.).

8. The process of claim 1 wherein said reduction time is selected based on the reduction temperature and the porosity of said iron oxides.

9. The process of claim 1 characterized in that said reduction time ranges from about 15 minutes to about 72 hours.

10. The process of claim 1 characterized in that said reduction time ranges from about 1.5 hours to about 48 hours.

11. The process of claim 1, wherein the metallurgical coke product and a reduced iron product from the coke oven are produced in a ratio of from about 0.11 to about 0.4 metric tons of reduced iron product per metric ton of coke product.

12. A process for simultaneously producing reduced iron from iron rich wastes and coke from metallurgical coal, said process comprising the steps of:

placing a layer of feedstock containing iron oxides on a bed comprising metallurgical coal;

placing said bed in a coke oven selected from the group consisting of non-recovery coke ovens and heat recovery coke ovens;

maintaining said coke oven at a reduction temperature for a selected cycle time, said reduction temperature being a temperature sufficient to reduce said iron oxides into reduced iron and to devolatizes said coal in said bed into coke;

providing a reducing gas in said coke oven during said selected cycle time, said reducing gas being a gas that causes said iron oxides to reduce to reduced iron at said reduction temperature;

heating said coke oven to a melting temperature greater than the melting point of said reduced iron and below the melting temperature of iron oxide so that the melted iron flows down into the coke bed a matter of inches to a point wherein the reduced iron solidifies, which point protects the reduced iron from reoxidation and wherein the reduced iron is not in contact with underlying refractory materials;

removing said bed and said reduced iron from said coke oven while keeping said coke bed substantially intact;

cooling said bed and said reduced iron to a temperature sufficient to solidify said reduced iron;

recovering a metallurgical coke product and a reduced iron product from the coke ovens; and separating the reduced iron product from the coke product, wherein the reduced iron product has a metallization of greater than 95 wt. %.

13. The process of claim 12 characterized in that said feedstock is selected from the group consisting of mill scale, hematite fines, magnetite fines, blast furnace dust, blast furnace sludge, basic oxygen furnace dust, basic oxygen furnace sludge, oily mill scale, and thermally treated electric arc furnace dust.

14. The process of claim 12 characterized in that said reducing gas consists essentially of $H_2$, $CH_4$, and CO.

15. The process of claim 12 characterized in that said iron oxides consist essentially of FeO, $Fe_2O_3$, and $Fe_3O_4$.

16. The process of claim 12 wherein said reduction temperature is ranges from about 760° C. (1400° F.) to about 1648° C. (3000° F.).

17. The process of claim 12 wherein said reduction temperature ranges from about 982° C. (1800° F.) to about 1398° C. (2550° F.).

18. The process of claim 12 characterized in that said reduction time ranges from about 15 minutes to about 72 hours.

19. The process of claim 12 characterized in that said reduction time ranges from about 1.5 hours to about 48 hours.

* * * * *